US009230494B2

(12) United States Patent
Hasegawa et al.

(10) Patent No.: US 9,230,494 B2
(45) Date of Patent: Jan. 5, 2016

(54) MULTI-PRIMARY COLOR LIQUID CRYSTAL PANEL DRIVE CIRCUIT, MULTI-PRIMARY COLOR LIQUID CRYSTAL PANEL DRIVE METHOD, LIQUID CRYSTAL DISPLAY DEVICE AND OVERDRIVE SETTING METHOD

(75) Inventors: Makoto Hasegawa, Osaka (JP); Kazunari Tomizawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 289 days.

(21) Appl. No.: 13/635,486

(22) PCT Filed: Mar. 16, 2011

(86) PCT No.: PCT/JP2011/056204
§ 371 (c)(1),
(2), (4) Date: Sep. 17, 2012

(87) PCT Pub. No.: WO2011/115169
PCT Pub. Date: Sep. 22, 2011

(65) Prior Publication Data

US 2013/0010014 A1 Jan. 10, 2013

(30) Foreign Application Priority Data

Mar. 18, 2010 (JP) ..... 2010-063298

(51) Int. Cl.
*G09G 3/36* (2006.01)

(52) U.S. Cl.
CPC ..... *G09G 3/3607* (2013.01); *G09G 2300/0452* (2013.01); *G09G 2320/0242* (2013.01);
(Continued)

(58) Field of Classification Search
None
See application file for complete search history.

(56) References Cited

U.S. PATENT DOCUMENTS 4,800,375 A * 1/1989 Silverstein ..... G02F 1/133514 345/694
7,268,757 B2 9/2007 Ben-David et al.
(Continued)

FOREIGN PATENT DOCUMENTS

EP 1990678 A1 * 11/2008
JP 09-251160 A 9/1997
(Continued)

OTHER PUBLICATIONS

Official Communication issued in International Patent Application No. PCT/JP2011/056204, mailed on Apr. 12, 2011.
(Continued)

*Primary Examiner* — Kathy Wang-Hurst
*Assistant Examiner* — Douglas Wilson
(74) *Attorney, Agent, or Firm* — Keating & Bennett, LLP

(57) ABSTRACT

A multi-primary-color liquid crystal panel driver (100) according to the present invention includes: a multi-primary-color converter (110) which performs a multi-primary-color conversion to convert the grayscale levels of an input video signal in each of a plurality of vertical scanning periods into grayscale levels of four or more primary colors; and an overdrive circuit (120) which sets, based on the grayscale levels that have been subjected to the multi-primary-color conversion in one vertical scanning period and on the grayscale levels that have been subjected to the multi-primary-color conversion in another vertical scanning period that is earlier than the one vertical scanning period by at least one period, the grayscale levels of the four or more primary colors in that one vertical scanning period. The present invention provides a multi-primary-color liquid crystal panel that can improve the display quality even when the input video signal has varying grayscale levels.

15 Claims, 13 Drawing Sheets

(52) U.S. Cl.
CPC ..... *G09G2320/0252* (2013.01); *G09G 2320/0693* (2013.01); *G09G 2340/06* (2013.01); *G09G 2340/16* (2013.01)

(56) References Cited

U.S. PATENT DOCUMENTS

| | | | | |
|---|---|---|---|---|
| 7,397,457 | B2 * | 7/2008 | Sugino | G09G 3/3611 345/100 |
| 7,427,993 | B1 * | 9/2008 | Zhang | G09G 3/3648 345/204 |
| 7,436,996 | B2 * | 10/2008 | Ben-Chorin | G09G 5/02 345/590 |
| 7,589,743 | B2 * | 9/2009 | Higgins | H04N 1/6075 345/589 |
| 7,598,961 | B2 * | 10/2009 | Higgins | G09G 3/2003 345/589 |
| 2004/0174389 | A1 * | 9/2004 | Ben-David | G09G 3/3413 345/694 |
| 2005/0007373 | A1 * | 1/2005 | Lim | G06F 3/1431 345/502 |
| 2005/0122294 | A1 * | 6/2005 | Ben-David | G09G 3/2003 345/87 |
| 2005/0125179 | A1 * | 6/2005 | Selby | G09G 3/006 702/85 |
| 2008/0122816 | A1 * | 5/2008 | Park | G09G 3/3648 345/204 |
| 2008/0165204 | A1 * | 7/2008 | Klompenhouwer | G09G 3/3413 345/589 |
| 2009/0021808 | A1 * | 1/2009 | Paul | H04N 1/603 358/518 |
| 2009/0087108 | A1 * | 4/2009 | Porter | G09G 3/2003 382/236 |
| 2009/0135213 | A1 * | 5/2009 | Tomizawa | G09G 3/2003 345/697 |
| 2009/0167657 | A1 * | 7/2009 | Tomizawa | G09G 3/2003 345/88 |
| 2009/0303262 | A1 * | 12/2009 | Son | G09G 3/3413 345/690 |
| 2009/0322779 | A1 * | 12/2009 | Tomizawa | H04N 9/67 345/590 |
| 2010/0091042 | A1 * | 4/2010 | Inoue | G09G 3/2025 345/690 |

FOREIGN PATENT DOCUMENTS

| | | | | |
|---|---|---|---|---|
| JP | 2001-209047 | A | 8/2001 | |
| JP | 2001-306023 | A | 11/2001 | |
| JP | 2003-207762 | A | 7/2003 | |
| JP | 2004-529396 | A | 9/2004 | |
| JP | 2005-031640 | A | 2/2005 | |
| JP | WO 2007097080 | A1 * | 8/2007 | G09G 3/2003 |
| JP | 2008-040384 | A | 2/2008 | |
| JP | 2008-538616 | A | 10/2008 | |
| JP | 2008-284128 | A | 11/2008 | |
| JP | EP 1990678 | A1 * | 12/2008 | G02F 1/133 |
| WO | 2007/032133 | A1 | 3/2007 | |
| WO | 2008/016015 | A1 | 2/2008 | |
| WO | 2008/146424 | A1 | 12/2008 | |

OTHER PUBLICATIONS

Yang et al.; "31.1: Development of Six Primary-Color LCD"; Society for Information Display, 2005 International Symposium Digest of Technical Papers; vol. XXXVI, Book II; May 25-27, 2005; pp. 1210-1213.

Chino et al.; "25.1: Invited Paper: Development of Wide-Color-Gamut Mobile Displays With Four-Primary-Color LCDS"; Society for Information Display, 2006 International Symposium Digest of Technical Papers; vol. XXXVII, Book II; Jun. 7-9, 2006; pp. 1221-1224.

Ben-Chorin; "Improving LCD TV Color Using Multi-Primary Technology"; FPD International 2005 Forum; Oct. 19, 2005; Total of 66 pages.

English translation of Official Communication issued in corresponding International Application PCT/JP2011/056204, mailed on Nov. 1, 2012.

* cited by examiner

MULTI-PRIMARY COLOR LIQUID CRYSTAL PANEL DRIVE CIRCUIT, MULTI-PRIMARY COLOR LIQUID CRYSTAL PANEL DRIVE METHOD, LIQUID CRYSTAL DISPLAY DEVICE AND OVERDRIVE SETTING METHOD

TECHNICAL FIELD

The present invention relates to a multi-primary-color liquid crystal panel driver, a method for driving a multi-primary-color liquid crystal panel, a liquid crystal display device, and an overdrive driving setting method.

BACKGROUND ART

LCDs have a number of advantages, including their lighter weight, reduced thickness and smaller power dissipation, over other kinds of display devices, and have been used as not only a display device with a small screen such as the monitor of a cellphone but also the big screen of a TV set. Recently, as there is an increasing demand for driving a liquid crystal display device at even higher rates, someone proposed a driving method, in which according to a combination of the grayscale levels of an input video signal in one and the previous vertical scanning periods, a different effective voltage from the one corresponding to the grayscale level in the former vertical scanning period is applied (see Patent Document No. 1, for example). Such a driving method is sometimes called an "overdrive driving", by which the display quality can be improved when the grayscale level of an input video signal changes.

Meanwhile, liquid crystal display devices that add four or more primary colors together have recently been proposed as a replacement for an ordinary liquid crystal display device that uses the three primary colors. A liquid crystal display device of the former type is sometimes called a "multi-primary-color liquid crystal display device". In general, a multi-primary-color liquid crystal display device uses not only the three primary colors (namely, red, green and blue) but also another primary color as well, and attempts to expand the color reproduction range. Also, a multi-primary-color liquid crystal display device performs a display operation by converting the grayscale levels of an input video signal that can be displayed by a normal three-primary-color display device into those corresponding to four or more primary colors (see Patent Documents Nos. 2 and 3). And such a conversion is called a "multi-primary-color conversion".

CITATION LIST

Patent Literature

Patent Document No. 1: Japanese Laid-Open Patent Publication No. 2003-207762

Patent Document No. 2: PCT International Application Japanese National Phase Patent Publication No. 2004-529396

Patent Document No. 3: PCT International Application Publication No. 2007/032133

SUMMARY OF INVENTION

Technical Problem

The present inventors discovered that if the overdrive driving and the multi-primary-color conversion are both adopted, the display quality sometimes cannot be improved sufficiently when the input video signal changes its grayscale level.

In order to overcome the problems described above, the present inventors perfected our invention by providing a multi-primary-color liquid crystal panel driver, a method for driving a multi-primary-color liquid crystal panel, a liquid crystal display device, and an overdrive driving setting method which can improve the display quality when an input video signal changes its grayscale level.

Solution to Problem

A multi-primary-color liquid crystal panel driver according to the present invention includes: a multi-primary-color converter which performs a multi-primary-color conversion to convert the grayscale levels of an input video signal in each of a plurality of vertical scanning periods into grayscale levels of four or more primary colors; and an overdrive circuit which sets, based on the grayscale levels that have been subjected to the multi-primary-color conversion in one vertical scanning period and on the grayscale levels that have been subjected to the multi-primary-color conversion in another vertical scanning period that is earlier than the one vertical scanning period by at least one period, the grayscale levels of the four or more primary colors in that one vertical scanning period.

In one embodiment, the overdrive circuit includes a plurality of grayscale level setting circuits which are provided for the four or more primary colors.

In one embodiment, the multi-primary-color liquid crystal panel driver further includes: a first circuit chip in which the multi-primary-color converter is built; and a second circuit chip in which the overdrive circuit is built.

In one embodiment, the multi-primary-color liquid crystal panel driver further includes: an input terminal, through which the input video signal is input; and a bypass path which connects the input terminal to the overdrive circuit without passing through the multi-primary-color converter.

In one embodiment, the multi-primary-color liquid crystal panel driver further includes at least one additional input terminal in addition to the input terminal, and the bypass path connects the input terminal and the additional input terminal to the overdrive circuit.

In one embodiment, the multi-primary-color liquid crystal panel driver further includes a switching element that selectively connects one of the multi-primary-color converter and the bypass path to the overdrive circuit.

In one embodiment, the multi-primary-color liquid crystal panel driver further includes a circuit chip in which the multi-primary-color converter and the overdrive circuit are integrated together.

In one embodiment, the multi-primary-color converter includes: a color component extracting section which extracts color components from the grayscale levels of the input video signal; and a grayscale level allocating section which allocates the color components to the grayscale levels of the four or more primary colors.

In one embodiment, the multi-primary-color converter converts the grayscale levels of the input video signal into the grayscale levels of the colors red, green, blue and yellow.

In one embodiment, if any of the grayscale levels that have been subjected to the multi-primary-color conversion changes from a first grayscale level corresponding to a first effective voltage into a second grayscale level corresponding to a second effective voltage, which is higher than the first effective voltage, and then remains the second grayscale level for multiple vertical scanning periods, the overdrive circuit changes the grayscale level into a one corresponding to a higher effective voltage than the second grayscale level's in a vertical scanning period in which the first grayscale level has changed into the second grayscale level and then sets the grayscale level to be the second grayscale level in the vertical scanning periods in which the second grayscale level is maintained.

In one embodiment, if any of the grayscale levels that have been subjected to the multi-primary-color conversion changes from a third grayscale level corresponding to a third effective voltage into a fourth grayscale level corresponding to a fourth effective voltage, which is lower than the third effective voltage, and then remains the fourth grayscale level for multiple vertical scanning periods, the overdrive circuit changes the grayscale level into a one corresponding to a lower effective voltage than the fourth grayscale level's in a vertical scanning period in which the third grayscale level has changed into the fourth grayscale level and then sets the grayscale level to be the fourth grayscale level in the vertical scanning periods in which the fourth grayscale level is maintained.

A liquid crystal display device according to the present invention includes: a multi-primary-color liquid crystal panel; and a multi-primary-color liquid crystal panel driver according to any of the embodiments of the present invention described above, which drives the multi-primary-color liquid crystal panel.

A method for driving a multi-primary-color liquid crystal panel according to the present invention includes the steps of: performing a multi-primary-color conversion to convert the grayscale levels of an input video signal in each of a plurality of vertical scanning periods into grayscale levels of four or more primary colors; and setting, based on the grayscale levels that have been subjected to the multi-primary-color conversion in one vertical scanning period and on the grayscale levels that have been subjected to the multi-primary-color conversion in another vertical scanning period that is earlier than the one vertical scanning period by at least one period, the grayscale levels of the four or more primary colors in that one vertical scanning period.

In one embodiment, if any of the grayscale levels that have been subjected to the multi-primary-color conversion changes from a first grayscale level corresponding to a first effective voltage into a second grayscale level corresponding to a second effective voltage, which is higher than the first effective voltage, and then remains the second grayscale level for multiple vertical scanning periods, the step of setting the grayscale levels of the four or more primary colors includes changing the grayscale level into a one corresponding to a higher effective voltage than the second grayscale level's in a vertical scanning period in which the first grayscale level has changed into the second grayscale level and then setting the grayscale level to be the second grayscale level in the vertical scanning periods in which the second grayscale level is maintained.

In one embodiment, if any of the grayscale levels that have been subjected to the multi-primary-color conversion changes from a third grayscale level corresponding to a third effective voltage into a fourth grayscale level corresponding to a fourth effective voltage, which is lower than the third effective voltage, and then remains the fourth grayscale level for multiple vertical scanning periods, the step of setting the grayscale levels of the four or more primary colors includes changing the grayscale level into a one corresponding to a lower effective voltage than the fourth grayscale level's in a vertical scanning period in which the third grayscale level has changed into the fourth grayscale level and then setting the grayscale level to be the fourth grayscale level in the vertical scanning periods in which the fourth grayscale level is maintained.

An overdrive driving setting method according to the present invention includes the steps of: providing a liquid crystal display device which includes a multi-primary-color liquid crystal panel and a multi-primary-color liquid crystal panel driver to drive the multi-primary-color liquid crystal panel, the liquid crystal panel driver including a multi-primary-color converter and an overdrive circuit; making measurement on the display of the multi-primary-color liquid crystal panel while adjusting overdrive driving for the overdrive circuit by inputting a grayscale level adjustable test signal to the overdrive circuit without passing through the multi-primary-color converter; and setting the mode of the overdrive driving to get done by the overdrive circuit based on a result of the measurement on the multi-primary-color liquid crystal panel.

Advantageous Effects of Invention

A multi-primary-color liquid crystal panel driver, method for driving a multi-primary-color liquid crystal panel, liquid crystal display device, and overdrive driving setting method according to the present invention can improve the display quality when an input video signal changes its grayscale level.

DESCRIPTION OF EMBODIMENTS

Hereinafter, embodiments of a multi-primary-color liquid crystal panel driver, method for driving a multi-primary-color liquid crystal panel, liquid crystal display device, and overdrive driving setting method according to the present invention will be described with reference to the accompanying drawings. However, the present invention is in no way limited to the specific embodiments to be described below.

Embodiment 1

Figure 1:
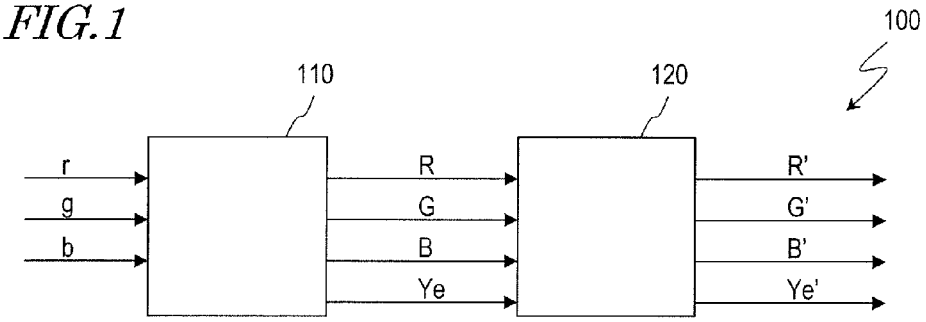
FIG. 1 Schematically illustrates a multi-primary-color liquid crystal panel driver as a first embodiment of the present invention.

Hereinafter, a first embodiment of a multi-primary-color liquid crystal panel driver according to the present invention will be described. FIG. 1 schematically illustrates a multi-primary-color liquid crystal panel driver 100 according to this embodiment. The multi-primary-color liquid crystal panel driver 100 includes a multi-primary-color converter 110 and an overdrive circuit 120.

The multi-primary-color converter 110 converts the grayscale levels of an input video signal into the grayscale levels of four or more primary colors in each of multiple vertical scanning periods with respect to each of a number of pixels. As described above, such a conversion is also called a "multi-primary-color conversion". In this example, the multi-primary-color converter 110 converts the red, green and blue grayscale levels r, g, b of the input video signal into red, green, blue and yellow grayscale levels R, G, B and Ye.

The input video signal may be compatible with a cathode ray tube (CRT) with a γ value of 2.2 and is compliant with the NTSC (National Television Standards Committee) standard. The input video signal represents the grayscale levels r, g and b of the colors red, green and blue. In general, the grayscale levels r, g and b are represented by eight bits. Or the input video signal may have a value that can be converted into the grayscale levels r, g and b of colors red, green and blue and that is represented as a three-dimensional value. It should be noted that if the input video signal is compliant with the BT. 709 standard, the grayscale levels r, g and b indicated by the input signal fall within the range of the lowest grayscale level (e.g., grayscale level 0) through the highest grayscale level (e.g., grayscale level 255). The input video signal may be YCrCb signal, for example. The grayscale levels indicated by the input video signal are converted by a multi-primary-color liquid crystal panel (to be described later) into luminance levels. As a result, effective voltages representing the luminance levels are applied to the liquid crystal layer. In the following description, the grayscale levels r, g and b of the input video signal mean not only the grayscale levels represented by the input video signal itself but also the grayscale levels obtained by converting the values of the input video signal. Also, the signal representing the grayscale levels R, G, B and Ye obtained by the multi-primary-color conversion will also be referred to herein as a "multi-primary-color signal".

The overdrive circuit 120 sets, based on the grayscale levels that have been subjected to the multi-primary-color conversion in one vertical scanning period and on the grayscale levels that have been subjected to the multi-primary-color conversion in another vertical scanning period that is earlier than the one vertical scanning period by at least one period, the grayscale levels of the four or more primary colors in that one vertical scanning period with respect to each of the pixels. If the grayscale levels that have been obtained by the multi-primary-color conversion over a series of vertical scanning periods change, then the grayscale levels are set so that the magnitude of the variation in the grayscale levels becomes greater than the original one.

For example, if a grayscale level corresponding to a low effective voltage changes into a grayscale level corresponding to a high effective voltage during a series of vertical scanning periods, then the overdrive circuit 120 sets a grayscale level to be a one corresponding to an even higher effective voltage. As a result, even liquid crystal molecules with low response speeds can also come to have an alignment state associated with the high effective voltage in a relatively short time. Or if a grayscale level corresponding to a high effective voltage changes into a grayscale level corresponding to a low effective voltage during a series of vertical scanning periods, then the overdrive circuit 120 sets a grayscale level to be a one corresponding to an even lower effective voltage. As a result, liquid crystal molecules can come to have an alignment state associated with the low effective voltage in a relatively short time. Such a driving method is called "overdrive driving". In this example, as a result of the overdrive driving by the overdrive circuit 120, grayscale levels R', G', B' and Ye' are obtained and a multi-primary-color signal representing these grayscale levels R', G', B' and Ye' is output to a multi-primary-color liquid crystal panel to be described later. Such a multi-primary-color liquid crystal panel driver 100 can be used effectively as a driver for a multi-primary-color liquid crystal panel that conducts a display operation using the colors red, green, blue, and yellow as the four primary colors.

Figure 2:
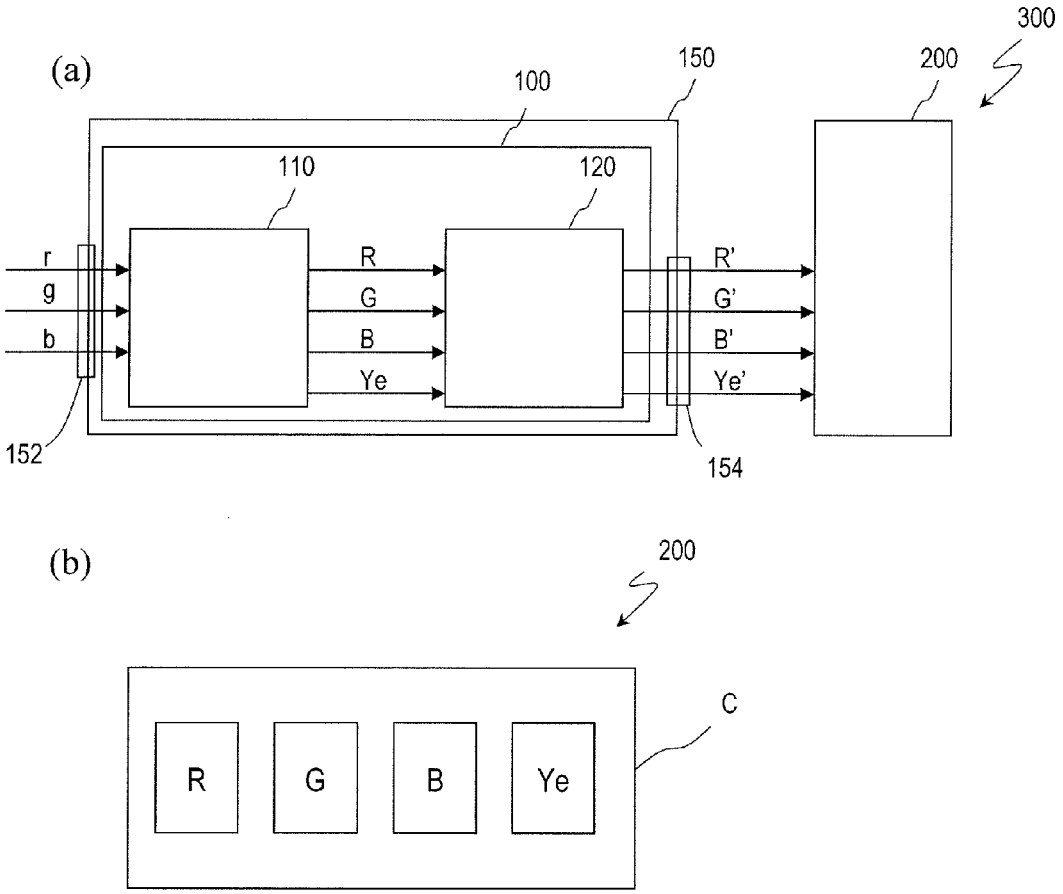
FIG. 2 (*a*) schematically illustrates a liquid crystal display device including the liquid crystal panel driver shown in FIG. 1 and (*b*) schematically illustrates the multi-primary-color liquid crystal panel shown in FIG. 2(*a*).

FIG. 2(*a*) schematically illustrates a liquid crystal display device 300 including the multi-primary-color liquid crystal panel driver 100 and a multi-primary-color liquid crystal panel 200. The multi-primary-color liquid crystal panel 200 is driven in response to a multi-primary-color signal supplied from the liquid crystal panel driver 100. Although not shown, the multi-primary-color liquid crystal panel 200 includes a front substrate, a rear substrate, and a liquid crystal layer interposed between the two substrates. For example, the liquid crystal layer may include a nematic liquid crystal material with negative dielectric anisotropy, and a display operation may be conducted in Normally Black mode by using that liquid crystal layer and polarizers that are arranged as crossed Nicols in combination. If it is a transmissive device or a transflective device, the multi-primary-color liquid crystal panel 200 further includes a backlight.

In this example, the multi-primary-color converter 110 and the overdrive circuit 120 are built in a circuit chip 150 with an input terminal 152 and an output terminal 154. The circuit chip 150 further includes lines that connect the input terminal 152 to the multi-primary-color converter 110, lines that connect the multi-primary-color converter 110 to the overdrive circuit 120, and lines that connect the overdrive circuit 120 to the output terminal 154. Although not shown, the circuit chip 150 is arranged in a timing controller that controls the timings of a gate signal supplied from a gate driver and a source signal supplied from a source driver.

When an input video signal is input through the input terminal 152 to the multi-primary-color converter 110, the multi-primary-color converter 110 converts the grayscale levels r, g and b of the input video signal into grayscale levels R, G, B and Ye. After that, the overdrive circuit 120 performs overdrive driving on the grayscale levels R, G, B and Ye, thereby obtaining grayscale levels R', G', B' and Ye'. As a result, a multi-primary-color signal representing these grayscale levels R', G', B' and Ye' is output through the output terminal 154 to the multi-primary-color liquid crystal panel 200. For example, when an effective voltage is applied to the liquid crystal layer between respective pixel electrodes on a rear substrate and a counter electrode, which is provided for a front substrate to face the pixel electrodes in the multi-primary-color liquid crystal panel 200, the voltage (which is typically a source signal voltage) applied to the pixel electrodes is set based on those grayscale levels R', G', B' and Ye'.

The circuit chip 150 is mounted in the frame area of the rear substrate of the multi-primary-color liquid crystal panel 200. By mounting the circuit chip 150, a multi-primary-color signal with the grayscale levels R', G', B' and Ye' that have been subjected to multi-primary-color conversion and overdrive driving can be generated with respect to the input video signal with the grayscale levels r, g and b. In the following description, the multi-primary-color liquid crystal panel driver 100 will sometimes be simply referred to herein as an "liquid crystal panel driver 100" and the "multi-primary-color liquid crystal panel 200" will be sometimes referred to herein as an "liquid crystal panel 200".

FIG. 2(*b*) schematically illustrates a single color display pixel C of the liquid crystal panel 200. The color display pixel C includes red, green, blue, and yellow pixels R, G, B and Ye. A single color display pixel C is divided into these four pixels R, G, B and Ye by defining four different pixel regions for each color display pixel region of color filters (not shown) that are provided for the liquid crystal panel 200.

In FIG. 2(*b*), the red, green, blue, and yellow pixels R, G, B and Ye are illustrated as having an equal area. However, the red, green, blue, and yellow pixels R, G, B and Ye may also have mutually different areas. Supposing the average of the respective areas of the red, green, blue, and yellow pixels R, G, B and Ye is called a "pixel average area", if the area of the red pixel R is larger than the pixel average area, a color red with a high degree of lightness can be represented sufficiently. Also, if the area of the blue pixel B is larger than the pixel average area, a decrease in the emission efficiency of the backlight can be minimized. For these reasons, the areas of the red and blue pixels R and B are suitably larger than those of the green and yellow pixels G and Ye.

Figure 3:
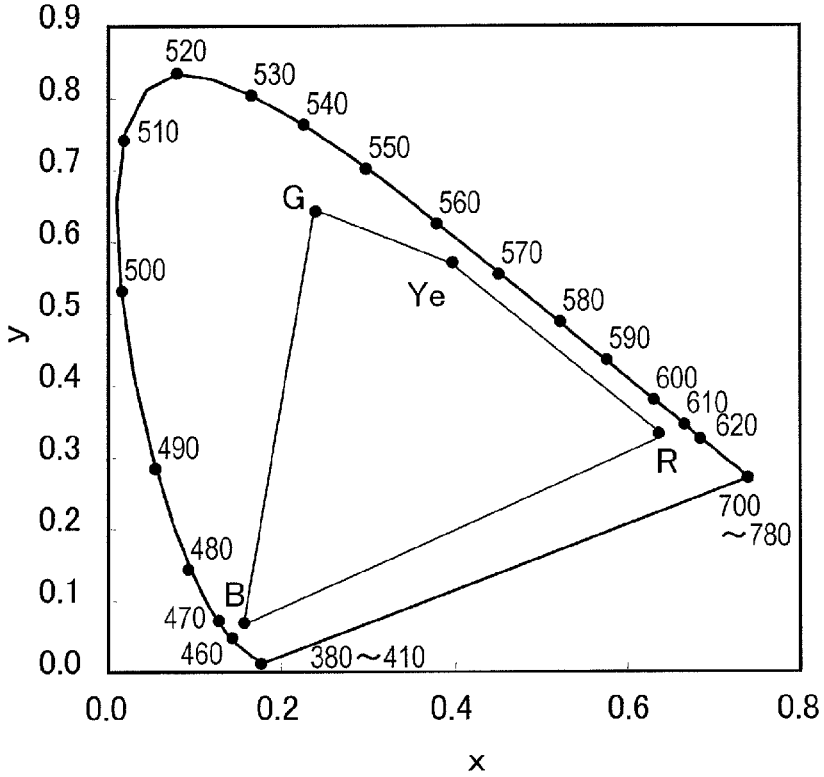
FIG. 3 An xy chromaticity diagram according to the XYZ color system in the multi-primary-color liquid crystal panel shown in FIG. 2(*a*).

FIG. 3 is an xy chromaticity diagram according to the XYZ color system in the liquid crystal panel 200. Each vertex indicates the xy chromaticity coordinates when only an associated one of the red, green, blue, and yellow pixels has the maximum grayscale level while the other pixels have the minimum grayscale level. In FIG. 3, the quadrangle drawn by connecting together the four vertices represents the color reproduction range of the liquid crystal panel 200. In this example, the chromaticity point of the yellow pixel in the multi-primary-color liquid crystal panel 200 is located outside of the line that connects together the chromaticity points of the red and green pixels. That is to say, the color reproduction range is expanded by the yellow pixel.

The following Table 1 shows the chromaticity values x and y and the Y value when one of the red, green, blue, and yellow pixels has its grayscale level increased to the maximum one in the liquid crystal panel 200. In this example, the Y value has been normalized so that a Y value becomes 1.0 in white display:

TABLE 1

| | X | y | Y value |
|---|---|---|---|
| Red pixel | 0.644 | 0.339 | 0.123 |
| Green pixel | 0.268 | 0.644 | 0.337 |
| Blue pixel | 0.144 | 0.053 | 0.126 |
| Yellow pixel | 0.392 | 0.567 | 0.413 |

For example, in a situation where the color represented by the input video signal changes so as to increase its luminance while being an achromatic color over multiple vertical scanning periods, as the luminance increases, the grayscale levels R, G, B and Ye of the colors red, green, blue, and yellow obtained in the multi-primary-color converter 110 increase. In that case, the grayscale levels R, G, B and Ye of the colors red, green, blue, and yellow increase at the same constant rate. On the other hand, in a situation where the color represented by the input video signal changes so as to increase its luminance while being a chromatic color with a certain hue over multiple vertical scanning periods, as the luminance increases, at least one of the grayscale levels R, G, B and Ye of the colors red, green, blue, and yellow obtained in the multi-primary-color converter 110 increases. In that case, however, the grayscale levels R, G, B and Ye of the colors red, green, blue, and yellow do not increase at the same rate. For example, in the multi-primary-color converter 110, as the luminance of the color yellow represented by the input video signal increases, the grayscale levels R, G and Ye of the colors red, green and yellow also increase. But the grayscale level Ye of the color yellow increases at a higher rate than the grayscale levels R and G of the colors red and green. And after the grayscale level Ye of the color yellow has reached the maximum grayscale level, the grayscale levels R and G of the colors red and green increase. In this manner, if the color represented by the input video signal changes in association with a chromatic color, the grayscale levels R, G, B and Ye of the colors red, green, blue, and yellow sometimes increase at varying rates as its luminance increases.

Also, the mode of the overdrive driving carried out by the overdrive circuit 120 may be set individually for each liquid crystal panel to be driven by the liquid crystal panel driver 100. The mode of the overdrive driving may be set by providing a liquid crystal display device 300 which includes the liquid crystal panel driver 100 and the liquid crystal panel 200, and obtaining a result of measurement that has been made on the display of the liquid crystal panel 200 while controlling the overdrive driving in response to a grayscale level adjustable test signal. In this example, the liquid crystal panel driver 100 is set up to output the grayscale level of the current vertical scanning period as it is without being affected by the grayscale level of the previous vertical scanning period before the overdrive driving is controlled.

Figure 4:
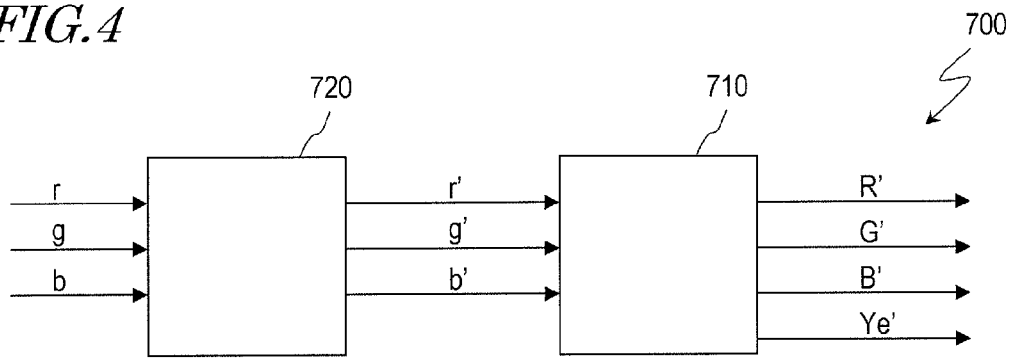
FIG. 4 Schematically illustrates a multi-primary-color liquid crystal panel driver as a comparative example.

Hereinafter, advantages of the liquid crystal panel driver 100 over a liquid crystal panel driver 700 representing a comparative example will be described. First of all, the liquid crystal panel driver 700 will be described with reference to FIG. 4.

The liquid crystal panel driver 700 includes a multi-primary-color converter 710 and an overdrive circuit 720. The overdrive circuit 720 performs overdrive driving on the red, green and blue grayscale levels r, g, b represented by an input video signal, thereby obtaining grayscale levels r', g' and b'. After that, the multi-primary-color converter 710 performs multi-primary-color conversion on these grayscale levels r', g' and b', thereby obtaining red, green, blue, and yellow grayscale levels R', G', B' and Ye'.

In the liquid crystal panel driver 700, after the overdrive circuit 720 has carried out overdrive driving, the multi-primary-color converter 710 carries out a multi-primary-color conversion. On the other hand, in the liquid crystal panel driver 100, after the multi-primary-color converter 110 has carried out a multi-primary-color conversion on an input video signal, the overdrive circuit 120 performs overdrive driving. As can be seen, the liquid crystal panel driver 700 performs the multi-primary-color conversion and the overdrive driving in a different order from the liquid crystal panel driver 100.

It should be noted that the liquid crystal panel driver 700 is obtained by adding the multi-primary-color converter 710 as a stage that follows the overdrive circuit 720, which is used to drive a general three-primary-color liquid crystal panel, in order to apply this driver 700 to a multi-primary-color liquid crystal panel. In this manner, in the liquid crystal panel driver 700, before the multi-primary-color conversion is carried out, the three grayscale levels represented by the input video signal are subjected to the overdrive driving, and therefore, an overdrive circuit which is used to drive an ordinary three-primary-color liquid crystal panel can be used as the overdrive circuit 720. However, some multi-primary-color liquid crystal panel to be driven by such a liquid crystal panel driver 700 cannot improve the display quality sufficiently when the grayscale level of the input video signal varies.

Now the grayscale levels R', G', B' and Ye' of the multi-primary-color signals that are obtained by supplying an input video signal, of which the luminance varies while representing an achromatic color, to the liquid crystal panel drivers 100 and 700 will be compared to each other. For example, the input video signal may represent the color black in the previous vertical scanning period and then represent the color grey in a subsequent vertical scanning period. Specifically, the grayscale levels (r, g, b) of the input video signal change from (0, 0, 0) into (96, 96, 96). In this example, to avoid an overly complicated description, if the grayscale levels R, G, B and Ye supplied to the overdrive circuit 120 and the grayscale levels r, g, b supplied to the overdrive circuit 720 each change from grayscale level #0 into grayscale level #96, grayscale level #144 is supposed to be obtained through the overdrive driving. In this example, if the input grayscale levels are the same, the grayscale levels obtained through the overdrive driving are supposed to be equal to each other. However, the grayscale levels obtained through the overdrive driving may also be different from one color to another.

If this input video signal is supplied to the liquid crystal panel driver 700 representing a comparative example, first of all, the overdrive circuit 720 carries out overdrive driving, thereby obtaining grayscale levels (r', g', b'), which become (144, 144, 144). The grayscale levels (R', G', B', Ye') obtained after that as a result of the multi-primary-color conversion by the multi-primary-color converter 710 become (144, 144, 144, 144).

On the other hand, if this input video signal is supplied to the liquid crystal panel driver 100, first of all, the multi-primary-color converter 110 carries out multi-primary-color conversion, thereby obtaining grayscale levels (R, G, B, Ye), which become (96, 96, 96, 96). Next, the overdrive circuit 120 performs overdrive driving, thereby obtaining grayscale levels (R', G', B', Ye'), which become (144, 144, 144, 144). As can be seen, if only the luminance of the input video signal changes while the color represented by it remains an achromatic color, the same grayscale levels R', G', B' and Ye' are eventually obtained, no matter which of the multi-primary-color conversion and the overdrive driving is carried out first. As a result, both of the liquid crystal panel drivers 100 and 700 can carry out the overdrive driving appropriately.

However, if the input video signal changes in terms of a chromatic color, the grayscale levels R', G', B' and Ye' eventually obtained could be different depending on the order in which the multi-primary-color conversion and the overdrive driving are carried out.

Next, let us consider what if the color represented by the input video signal changes in terms of a chromatic color. In this example, the grayscale levels R', G', B' and Ye' of the multi-primary-color signals obtained by giving an input video signal, which represents colors changing from an achromatic color into a chromatic color, to the liquid crystal panel drivers 100 and 700 will be compared to each other. For example, the input video signal is supposed to represent the color black in the previous vertical scanning period and then represent the color yellow in a subsequent vertical scanning period. Specifically, in that case, the grayscale levels (r, g, b) of the input video signal change from (0, 0, 0) into (96, 96, 0).

If this input video signal is supplied to the liquid crystal panel driver 700 of the comparative example, first of all, the overdrive circuit 720 carries out overdrive driving, thereby obtaining grayscale levels (r', g', b'), which become (144, 144, 0). The overdrive circuit 720 carries out overdrive driving on the input grayscale levels on an individual basis. That is why if the grayscale level supplied to the overdrive circuit 720 changes from grayscale level #0 into grayscale level #96, grayscale level #144 will always be obtained as a result of the overdrive driving, irrespective of the color represented by the input video signal. Consequently, the grayscale levels (R', G', B', Ye') obtained after that as a result of the multi-primary-color conversion by the multi-primary-color converter 710 become (80, 60, 0, 170).

On the other hand, if this input video signal is supplied to the liquid crystal panel driver 100, first of all, the multi-primary-color converter 110 carries out multi-primary-color conversion, thereby obtaining grayscale levels (R, G, B, Ye), which become (32, 32, 0, 128). Next, the overdrive circuit 120 performs overdrive driving, thereby obtaining grayscale levels (R', G', B', Ye'), which become (48, 48, 0, 192). As can be seen, if the colors represented by the input video signal change in terms of a chromatic color, the grayscale levels R', G', B', Ye' eventually obtained are quite different depending on which of the multi-primary-color conversion and the overdrive driving is carried out first. Particularly when the color represented by the input video signal is based on either the color yellow or the color green, there is a significant difference between those two sets of grayscale levels R', G', B', Ye'.

As described above, if the grayscale levels r, g, b of the input video signal change, then two different sets of grayscale levels R', G', B' and Ye' are obtained by the liquid crystal panel drivers 100 and 700. However, unless the grayscale levels r, g, b of the input video signal change through multiple vertical scanning periods, the same set of grayscale levels R', G', B' and Ye' is obtained by the liquid crystal panel drivers 100 and 700. For example, if the grayscale levels (r, g, b) of the input video signal remain (96, 96, 0) through multiple vertical scanning periods, then no overdrive driving will be performed by the overdrive circuits 120 and 720 and both of the liquid crystal panel drivers 100 and 700 output a multi-primary-color signal, of which the grayscale levels (R', G', B', Ye') are (32, 32, 0, 128).

As described above, if the grayscale levels r, g, b of the input video signal change, the multi-primary-color liquid crystal panel driven by the liquid crystal panel driver 700 displays a different color from the multi-primary-color liquid crystal panel 200 driven by the liquid crystal panel driver 100. Compare the colors displayed by these multi-primary-color liquid crystal panels to what is represented by the input video signal, and it can be seen that if the grayscale levels of the input video signal change, the multi-primary-color liquid crystal panel driven by the liquid crystal panel driver 700 displays a quite different color from what is represented by the input video signal. On the other hand, even if the grayscale levels of the input video signal change, the multi-primary-color liquid crystal panel 200 driven by the liquid crystal panel driver 100 can still display the same color as what is represented by the input video signal. The reason would be as follows.

If the grayscale levels r, g, b of the input video signal change, not only multi-primary-color conversion by the multi-primary-color converter 110, 710 but also overdrive driving by the overdrive circuit 120, 720 are carried out. In the liquid crystal panel driver 700 of the comparative example that has already been described with reference to FIG. 4, the overdrive circuit 720 is set up to carry out overdrive driving on the grayscale levels of the three primary colors. The settings of the overdrive driving are determined based on the grayscale level of an associated one of the primary colors and are not affected by the grayscale level of any other primary color. For instance, the settings of the overdrive driving on the grayscale level of the color green are determined based on the grayscale level g of the input video signal and are not affected by the grayscale level r, b of the input video signal. Specifically, the same overdrive driving is carried out on the grayscale level of the color green whether the grayscale levels (r, g, b) of the input video signal are (96, 96, 96) or (0, 96, 0). In this manner, in the overdrive circuit 720, the settings of the overdrive driving are determined individually on the grayscale levels r, g, b. That is why even if the multi-primary-color converter 710 performs a multi-primary-color conversion so that the grayscale levels r', g', b' are correlated with each other, sometimes the overdrive driving cannot get done appropriately.

Also, it seems that if the liquid crystal panel driver 700 completely understands the details of the multi-primary-color conversion, the mode of the overdrive driving can be set adaptively to the multi-primary-color liquid crystal panel. For example, it appears that if the mode of the overdrive driving is set so that the grayscale levels R', G', B', Ye' obtained through the multi-primary-color conversion become (48, 48, 0, 192) eventually, the overdrive driving can get done appropriately. Actually, however, the overdrive driving is set simply so as to be carried out individually on the given grayscale level and not to be affected by any other grayscale level. Generally speaking, a multi-primary-color conversion is carried out to obtain a single combination of four grayscale levels with respect to a given combination of three grayscale levels. Thus, it can be said that for that purpose, only one of multiple different combinations of grayscale levels that can display a single color represented by the given three grayscale levels is chosen. On the other hand, the overdrive driving is carried out individually on the given grayscale level. For example, if the grayscale levels r', g', b' are (144, 144, 0) as described above, then the multi-primary-color converter 710 carries out a multi-primary-color conversion so that the grayscale levels R', G', B', Ye' become (80, 60, 0, 170). However, there is not always a particular combination of the grayscale levels r', g', b' that enable the multi-primary-color converter 710 to carry out a multi-primary-color conversion to make the grayscale levels R', G', B', Ye' (48, 48, 0, 192) in accordance with the color represented by the input video signal.

As can be seen, in the liquid crystal panel driver 700, the multi-primary-color conversion is carried out after the overdrive driving has been done, and therefore, sometimes appropriately set overdrive driving cannot be done after all. On the other hand, in the liquid crystal panel driver 100, the overdrive driving is carried out on an individual basis on the grayscale levels R, G, B, Ye that have been obtained through the multi-primary-color conversion, and therefore, simply set overdrive driving can get done appropriately.

Figure 5:
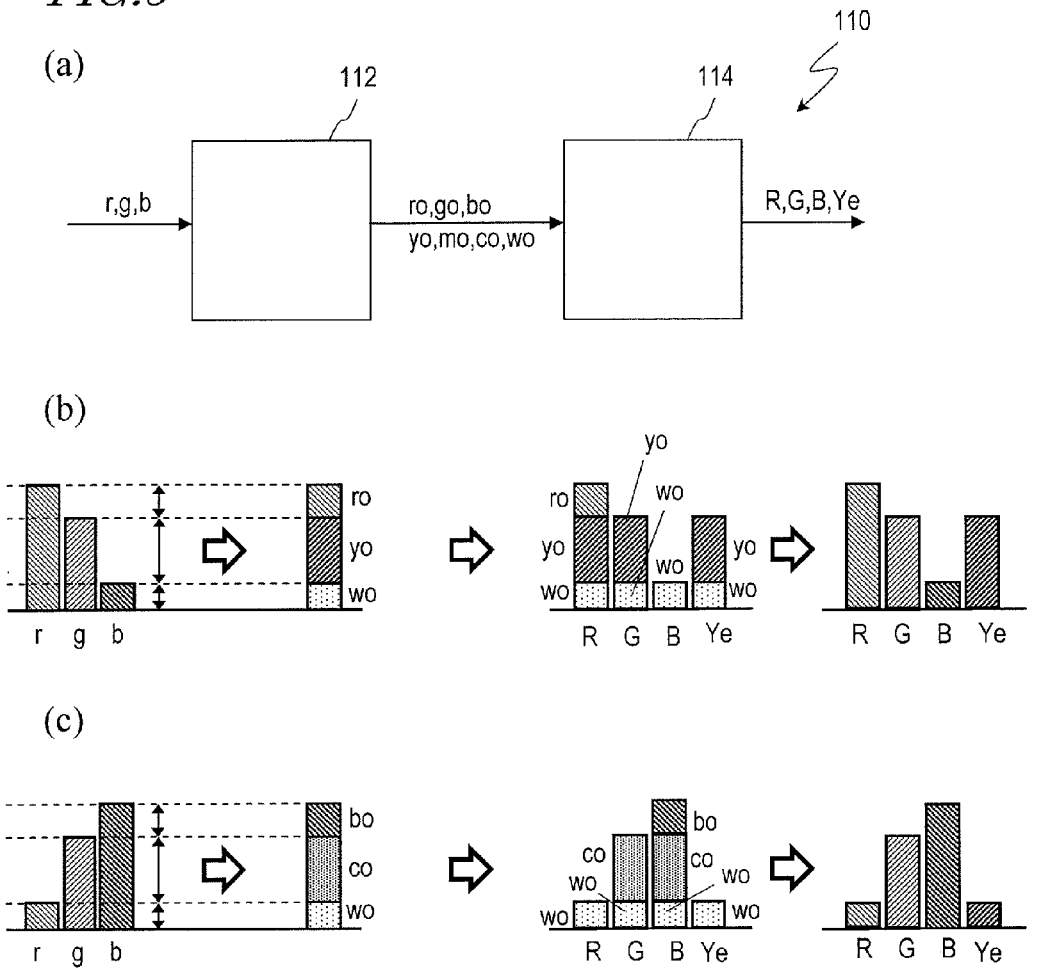
FIG. 5 (*a*) schematically illustrates the multi-primary-color converter shown in FIG. 1 and (*b*) and (*c*) schematically illustrate how to perform a multi-primary-color conversion.

Hereinafter, it will be described with reference to FIG. 5 how the multi-primary-color converter 110 carries out the multi-primary-color conversion. FIG. 5(*a*) schematically illustrates the multi-primary-color converter 110, which includes a color component extracting section 112 and a grayscale level allocating section 114.

The color component extracting section 112 extracts color components from the red, green and blue grayscale levels r, g, b of the input video signal. In this case, the color components that can be extracted include red, green, blue, yellow, magenta, cyan and achromatic color components ro, go, bo, yo, mo, co and wo. Typically, at least two of the red, green and blue components ro, go, bo become zero, and at least two of the yellow, magenta and cyan components yo, mo, co become zero, too.

The color components may be extracted in accordance with the relation between the grayscale levels r, g, b of the input video signal, for example. Specifically, if all of the grayscale levels r, g, b are the same, then a component shared in common by the grayscale levels r, g, b is extracted as the achromatic color component wo. For example, if the grayscale levels r, g, b are all grayscale level #100, then the red, green, blue and yellow grayscale levels R, G, B and Ye allocated to the achromatic color component wo have the grayscale level #100. It should be noted that if the grayscale levels r, g, b are all zero, no color components are extracted and the red, green, blue, and yellow grayscale levels R, G, B and Ye become zero, which corresponds to the color black.

On the other hand, if none of the grayscale levels r, g, b are zero, then the color component extracting section 112 extracts a component shared in common by the grayscale levels r, g, b (i.e., a component corresponding to the lowest one of the three grayscale levels r, g, b) as the achromatic color component wo. Also, the color component extracting section 112 extracts the yellow, magenta and cyan components yo, mo and co based on the difference between the lowest and second lowest ones of the grayscale levels r, g, b. If there is a difference between the lowest and second lowest ones of the grayscale levels r, g, b, one of the yellow, magenta and cyan components yo, mo and co is extracted based on that difference. On the other hand, if there is no difference between the lowest and second lowest ones of the grayscale levels r, g, b, none of the yellow, magenta and cyan components yo, mo and co are extracted.

Furthermore, the color component extracting section 112 extracts the red, green and blue components ro, go and bo based on the difference between the highest and second highest ones of the grayscale levels r, g, b. If there is a difference between the highest and second highest ones of the grayscale levels r, g, b, one of the red, green and blue components ro, go and bo is extracted according to that difference. On the other hand, if there is no difference between the highest and second highest ones of the grayscale levels r, g, b, none of the red, green and blue components ro, go and bo are extracted.

It should be noted that if one of the grayscale levels r, g, b is zero, then no achromatic color components wo are extracted but any of the yellow, magenta and cyan components yo, mo, co and/or any of the red, green and blue components ro, go, bo are extracted. On the other hand, if two of the grayscale levels r, g, b are zero, then any of the red, green and blue components ro, go and bo corresponding to the non-zero one of the grayscale levels r, g, b is extracted.

The grayscale level allocating section 114 allocates the color components that have been extracted by the color component extracting section 112 to the grayscale levels of the primary colors, which correspond to the primary colors of the multi-primary-color liquid crystal panel 200.

For example, the grayscale level allocating section 114 allocates the achromatic color component wo to the red, green, blue and yellow grayscale levels at an even ratio, the red component ro to the red grayscale level, the green component go to the green grayscale level, and the blue component bo to the blue grayscale level, respectively. Also, the grayscale level allocating section 114 allocates the yellow component yo to the red, green and yellow grayscale levels at an even ratio, the cyan component co to the green and blue grayscale levels at an even ratio, and the magenta component mo to the red and blue grayscale levels at an even ratio, respectively. In this case, each color component is proportional to the grayscale level of the primary color to which that color component is allocated. Furthermore, if any color component is associated with multiple primary colors, then the color component is allocated to the respective primary colors at an even ratio.

As a result, the red grayscale level R is set based on the achromatic color, red, yellow and magenta components wo, ro, yo and mo. The green grayscale level G is set based on the achromatic color, green, yellow and cyan components wo, go, yo and co. The blue grayscale level B is set based on the achromatic color, blue, cyan and magenta components wo, bo, co and mo. And the yellow grayscale level Ye is set based on the achromatic color and yellow components wo and yo. Each of these red, green, blue, and yellow grayscale levels R, G, B and Ye becomes the sum of the values that are allocated to the respective color components, for example. After that, the grayscale level allocating section 114 outputs a multi-primary-color signal representing the red, green, blue, and yellow grayscale levels R, G, B and Ye.

Hereinafter, it will be described with reference to FIGS. 5(*b*) and 5(*c*) specifically how the multi-primary-color converter 110 performs the multi-primary-color conversion. FIG. 5(*b*) schematically illustrates how to make a multi-primary-color conversion on grayscale levels r, g, b that satisfy the relation $r>g>b>0$.

The color component extracting section 112 extracts a component corresponding to the blue grayscale level b, which is the lowest one of the grayscale levels r, g, b of the input video signal, as an achromatic color component wo, a component representing the difference between the lowest and second lowest ones g, b of the grayscale levels r, g, b as a yellow component yo, and a component representing the difference between the highest and second highest ones r, g of the grayscale levels r, g, b as a red component ro, respectively. The grayscale level allocating section 114 allocates the achromatic color component wo to the red, green, blue, and yellow grayscale levels, the yellow component yo to the red, green and yellow grayscale levels, and the red component ro to the red grayscale level, respectively. As a result, the red grayscale level R is set based on the achromatic color, yellow and red components wo, yo and ro. The green grayscale level G is set based on the achromatic color and yellow components wo and yo. The blue grayscale level B is set based on the achromatic color component wo. And the yellow grayscale level Ye is set based on the achromatic color and yellow components wo and yo. After that, the grayscale level allocating section 114 outputs a multi-primary-color signal representing the red, green, blue, and yellow grayscale levels R, G, B and Ye.

FIG. 5(*c*) schematically illustrates how to make a multi-primary-color conversion on the grayscale levels r, g, b that satisfy the relation $0<r<g<b$. Based on the grayscale levels r, g, b of the input video signal, the color component extracting section 112 extracts a component corresponding to the red grayscale level r, which is the lowest one of the grayscale levels r, g, b, as an achromatic color component wo, a component representing the difference between the lowest and second lowest ones r, g of the grayscale levels r, g, b as a cyan component co, and a component representing the difference between the highest and second highest ones g, b of the grayscale levels r, g, b as a blue component bo, respectively. The grayscale level allocating section 114 allocates the achromatic color component wo to the red, green, blue, and yellow grayscale levels, the cyan component co to the green and blue grayscale levels, and the blue component bo to the blue grayscale level, respectively. As a result, the red grayscale level R is set based on the achromatic color component wo. The green grayscale level G is set based on the achromatic color and cyan components wo and co. The blue grayscale level B is set based on the achromatic color, cyan and blue components wo, co, bo. And the yellow grayscale level Ye is set based on the achromatic color component wo. After that, a multi-primary-color signal representing the red, green, blue, and yellow grayscale levels R, G, B and Ye is output.

In the examples described above, the grayscale levels r, g, b of the input video signal are supposed to satisfy either the relation $r>g>b>0$ or the relation $0<r<g\leq b$. However, the multi-primary-color conversion may also be carried out in the same way even if the grayscale levels of the input video signal satisfy any other relation.

Also, in the examples described above, if a color component is associated with multiple primary colors, then the color component is supposed to be allocated to those primary colors at an even ratio. However, this is just an example of the present invention. Alternatively, the color component may also be allocated to respective primary colors at an uneven ratio. Furthermore, although the grayscale levels of the primary colors increase proportionally as the color component increases, this is only an example of the present invention and the grayscale levels of the primary colors do not have to increase proportionally to the color component. For example, the yellow component yo does not have to be allocated to the red, green, and yellow grayscale levels at an even ratio. Furthermore, the red, green and yellow grayscale levels do not have to increase at a constant rate as the yellow component yo increases.

Hereinafter, it will be described with reference to FIGS. 6 through 8 how the red, green and yellow grayscale levels change with the yellow component yo.

Figure 6:
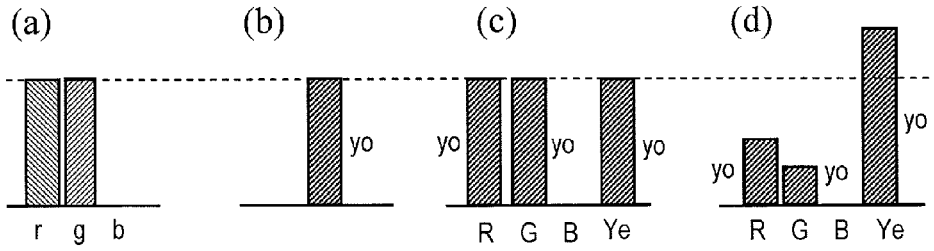
FIG. 6 (*a*) schematically shows the grayscale levels of an input video signal, (*b*) schematically shows a color component extracted, (*c*) schematically shows the grayscale levels that have been allocated based on the color component, and (*d*) schematically shows the grayscale levels that have been allocated at a different ratio from in FIG. 6(*c*).

FIG. 6(*a*) shows the red, green and blue grayscale levels r, g, b of the input video signal. In this example, the input video signal represents the color yellow, the grayscale levels r and g of the input video signal are equal to each other, and the grayscale level b is zero.

FIG. 6(*b*) shows the color component that has been extracted by the color component extracting section 112. In this example, the yellow component yo has been extracted.

FIG. 6(*c*) shows how the yellow component yo has been allocated to the grayscale levels R, G, B and Ye. In this example, the yellow component yo has been allocated to the red, green and yellow grayscale levels R, B and Ye at an even ratio as described above.

FIG. 6(*d*) shows how a yellow component yo that accounts for more than a predetermined percentage has been allocated to the grayscale levels R, G, B and Ye. In this case, the yellow component yo has been allocated to the red, green and yellow grayscale levels R, B and Ye at an uneven ratio. It can be seen that compared to the situation shown in FIG. 6 (*c*), the red and green grayscale levels to which the yellow component yo has been allocated have decreased, but the yellow grayscale level to which the yellow component yo has also been allocated has increased. Strictly speaking, the percentage of decrease in green grayscale level is smaller than the percentage of decrease in red grayscale level.

Figure 7:
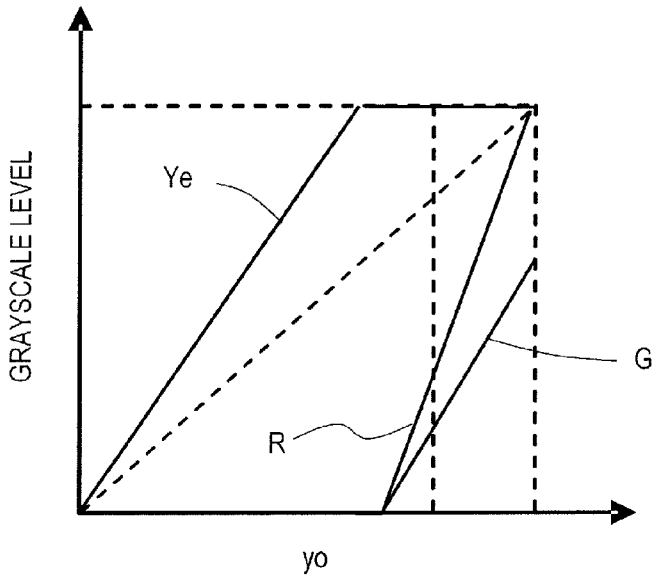
FIG. 7 A graph showing how the red, green, and yellow grayscale levels, to which a yellow component has been allocated, change in the multi-primary-color converter shown in FIG. 1.

FIG. 7 is a graph showing how the red, green, and yellow grayscale levels change as the percentage of the yellow component yo varies. FIG. 6(*d*) illustrates a situation where the percentage of the yellow component yo shown in FIG. 7 is relatively high. As the percentage of the yellow component yo rises, the yellow grayscale level increases. And before the percentage of the yellow component yo reaches its maximum value, the yellow grayscale level reaches the maximum grayscale level. After that, the higher the percentage of the yellow component yo, the higher the red and green grayscale levels. In this example, the gradient of the variation in red grayscale level with the increase in the percentage of the yellow component yo is steeper than that of the variation in green grayscale level. In this case, by representing the yellow component yo by using effectively yellow pixels, of which the chromaticity points are located outside of those of red and green pixels, particularly at low grayscale levels, a display operation can be carried out by using the broad color reproduction range effectively.

In FIG. 7, as the percentage of the yellow component yo rises, the yellow, red and green grayscale levels are supposed to vary with constant gradients. However, this is just an example of the present invention.

Figure 8:
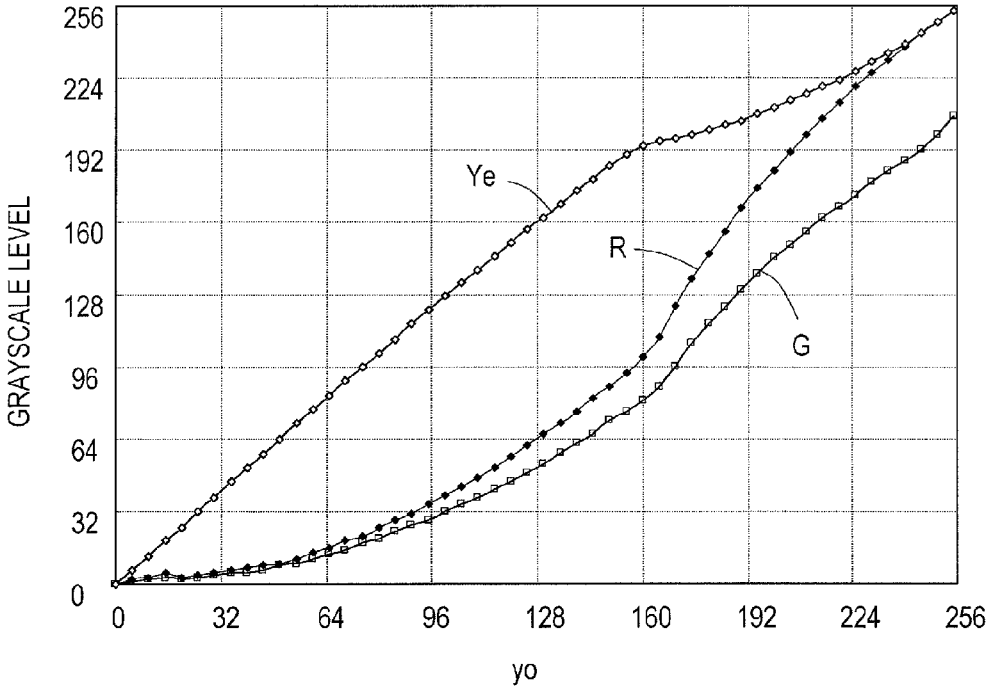
FIG. 8 A graph showing how the red, green, and yellow grayscale levels, to which a yellow component has been allocated, change in the multi-primary-color converter shown in FIG. 1.

FIG. 8 is a graph showing how the red, green and yellow grayscale levels change as the percentage of the yellow component yo varies. In this example, the variations in red, green and yellow grayscale levels with the increase in the percentage of the yellow component yo do not have constant gradients. Particularly in a low grayscale range, the yellow grayscale level is higher than the red and green grayscale levels. The liquid crystal panel 200 is designed so as to conduct a display operation to make the color yellow represented by yellow pixels thicker than the one represented by red and green pixels. That is why by changing the grayscale levels in this manner, the color reproduction range that has been broadened by adding yellow pixels can be used efficiently. Although it depends on the chromaticities of the four primary colors, the red grayscale level is higher than the green grayscale level in this example with respect to the same percentage of the yellow component yo. For example, if the percentage of the yellow component yo corresponds to grayscale level #144, then the red, green and yellow grayscale levels are 80, 60 and 170, respectively. Also, in the middle to high grayscale ranges, the gradient of the variation in red grayscale level with the increase in the percentage of the yellow component yo is steeper than those of the green and yellow grayscale levels. And at the maximum value of the percentage of the yellow component yo, the red grayscale level is substantially equal to the yellow grayscale level.

In the foregoing description, the red, green and blue components ro, go and bo are supposed to be allocated to their associated red, green and blue grayscale levels. However, this is only an example of the present invention. The red, green and blue components ro, go and bo may also be allocated to the grayscale levels of other primary colors instead of their associated red, green and blue grayscale levels. For example, the green component go may be allocated to not only the green grayscale level but the blue and yellow grayscale levels as well.

Hereinafter, it will be described with reference to FIGS. 9 and 10 how the green, blue and yellow grayscale levels change with an increase in the percentage of a green component go.

Figure 9:
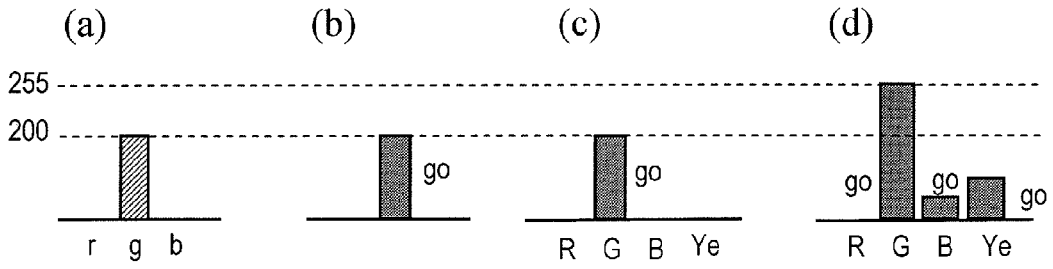
FIG. 9 (*a*) schematically shows the grayscale levels of an input video signal, (*b*) schematically shows a color component extracted, (*c*) schematically shows the grayscale level that has been allocated based on the color component, and (*d*) schematically shows the grayscale levels that have been allocated at a different ratio from in FIG. 9(*c*).

FIG. 9(*a*) shows the grayscale levels r, g, b of an input video signal. In this example, the red, green and blue grayscale levels r, g, b are 0, 200 and 0, respectively.

FIG. 9(*b*) shows the green component go that has been extracted from the input video signal. The percentage of the green component go corresponds to grayscale level #200.

FIG. 9(*c*) shows how the green component go is allocated to the grayscale levels R, G, B, Ye. In this example, the green component go is allocated to the green grayscale level G.

FIG. 9(*d*) shows how a green component go that accounts for more than a predetermined percentage has been allocated to the grayscale levels R, G, B and Ye. In this case, the green component go has been allocated to not only the green grayscale level but also the blue and yellow grayscale levels as well. However, the blue and yellow grayscale levels are much lower than the green grayscale level. The green component's grayscale level is set to be the maximum grayscale level #255, which is higher than the grayscale level #200 corresponding to the green component go. Strictly speaking, the blue grayscale level is lower than the yellow grayscale level.

Figure 10:
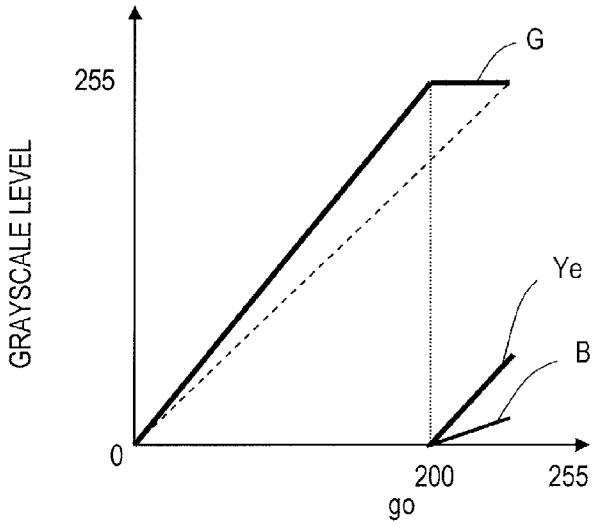
FIG. 10 A graph showing how the green, blue and yellow grayscale levels, to which a yellow component has been allocated, change in the multi-primary-color converter shown in FIG. 1.

FIG. 10 is a graph showing variations in the green, blue and yellow grayscale levels to which the green component go has been allocated. FIG. 9(*d*) illustrates a situation where the percentage of the green component go shown in FIG. 10 is relatively high. As the percentage of the green component go rises, the green grayscale level increases. And before the percentage of the green component go reaches its maximum value, the green grayscale level reaches the maximum grayscale level. For example, the percentage of the green component go when the green grayscale level reaches the maximum grayscale level #255 corresponds to grayscale level #200. After that, the higher the percentage of the green component go, the higher the blue and yellow grayscale levels. In this example, the gradient of the variation in yellow grayscale level with the increase in the percentage of the green component go is steeper than that of the variation in blue grayscale level.

If such a multi-primary-color conversion is looked at from the standpoint of chromaticities, it can be seen that the chromaticities can be adjusted appropriately because the green component is allocated to not just the green grayscale level but also the blue and yellow grayscale levels as well. Also, in general, if the color display pixels have the same size, three pixels (namely, red, green and blue pixels) of a multi-primary-color display device have smaller areas than red, green and blue pixels of a three-primary-color display device. That is why if the red, green and blue components ro, go, bo are just allocated to their associated red, green and blue grayscale levels R, G, B, sometimes sufficiently high luminances cannot be obtained. However, if the allocation ratio of the primary color green is set to be relatively high with respect to the green component go and if the green component go is allocated to not just the primary color green but also other primary colors blue and yellow as well, a decrease in the luminance of the multi-primary-color liquid crystal panel 200 can be minimized.

In the example described above, while the percentage of the green component go is changed from its minimum value to its maximum value, the percentage of the green component go is increased to a predetermined value until the green grayscale level reaches the maximum grayscale level. After that, the other grayscale levels are raised. However, this is just an example of the present invention. Alternatively, even after the green grayscale level has reached the maximum grayscale level, the other grayscale levels do not have to be increased. Still alternatively, the green grayscale level may also vary in a curve, of which the gradient is initially steep but gradually decreases afterward as the percentage of the green component go increases. That is to say, the green grayscale level may also vary in a convex curve with respect to the green component go.

It should be noted that what has just been described with reference to FIGS. 5 through 10 does not relate to only when to change the grayscale levels of the respective primary colors as the grayscale level of the input video signal or the percentage of a color component varies. Rather it is nothing but an algorithm for setting the grayscale levels to be obtained by the multi-primary-color converter 110 as the grayscale level of the input video signal or the percentage of a color component varies. That is to say, in the multi-primary-color converter 110, combinations of the grayscale levels of the respective primary colors according to the grayscale level of the input video signal or the percentage of a color component shown in FIGS. 5 to 10 are made based on the algorithm described above. In other words, FIGS. 5 to 10 show not only exactly when the grayscale levels of the respective primary colors change but also the red, green, blue, and yellow grayscale levels obtained by the multi-primary-color converter 110 as well. It should be noted that the multi-primary-color conversion may be either provided in advance based on the algorithm described above or created through computations.

Figure 11:
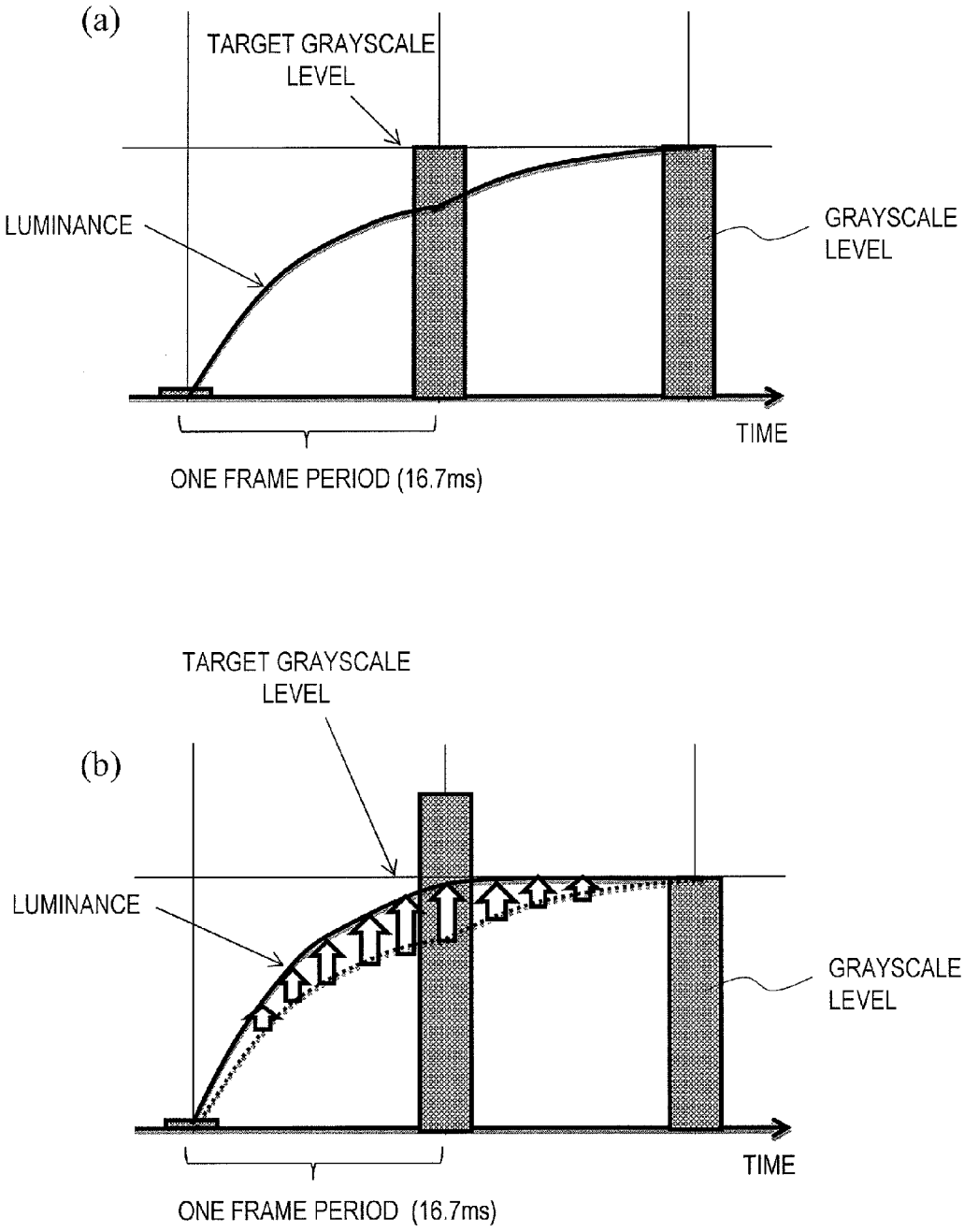
FIG. 11 (*a*) schematically shows how the luminance changes when no overdrive driving is performed, and (*b*) schematically shows how the luminance changes when overdrive driving is performed.

Next, it will be described with reference to FIGS. 11 and 12 how the overdrive circuit 120 performs overdrive driving. FIG. 11(*a*) shows how the luminance of the multi-primary-color liquid crystal panel 200 changes when no overdrive driving is performed, while FIG. 11(*b*) shows how the luminance of the multi-primary-color liquid crystal panel 200 changes when overdrive driving is performed. In this case, the grayscale level obtained through the multi-primary-color conversion remains zero over a series of vertical scanning periods and then changes into a middle grayscale level over the next series of vertical scanning periods. To avoid overly complicated description, attention will be paid to the red grayscale level and red pixels of the multi-primary-color liquid crystal panel 200.

If a liquid crystal display device is used as a part of a TV set, one frame period is set to be 16.7 ms (or 8.3 ms in a 2× drive panel to be driven at 120 Hz). If one frame period is as short as this, the liquid crystal molecules may sometimes be unable to change their alignment state quickly enough in response to a variation in the effective voltage applied to the liquid crystal layer. As shown in FIG. 11(*a*), if no overdrive driving is carried out, a voltage corresponding to a grayscale level R (i.e., the target grayscale level) obtained by subjecting the input video signal to a multi-primary-color conversion is applied to the liquid crystal layer of red pixels. After that, the grayscale level obtained through the multi-primary-color conversion does not change, and therefore, the effective voltage applied is constant. In this case, look at the luminance in a vertical scanning period right after the grayscale level has changed, and it can be seen that the luminance does not vary sufficiently. The reason is that even though the effective voltage changes, the liquid crystal molecules cannot respond quickly enough to get aligned in a predetermined direction promptly. In this manner, the variation in luminance reflects the response speed of the liquid crystal molecules.

On the other hand, if the overdrive driving has been carried out, the grayscale level R' is higher than the grayscale level R obtained by subjecting the grayscale level r of the input video signal to a multi-primary-color conversion as shown in FIG. 11(*b*). Thus, the effective voltage actually applied to the liquid crystal layer of red pixels becomes relatively high. Even though the grayscale level obtained through the multi-primary-color conversion does not change after that, the effective voltage applied does decrease and eventually becomes constant. In this case, look at a vertical scanning period right after the grayscale level has changed, and it can be seen that the luminance varies sufficiently. The reason is that right after the grayscale level has changed, the effective voltage varies more significantly than what is expected from the change of the grayscale level and liquid crystal molecules can get aligned in a predetermined direction.

Figure 12:
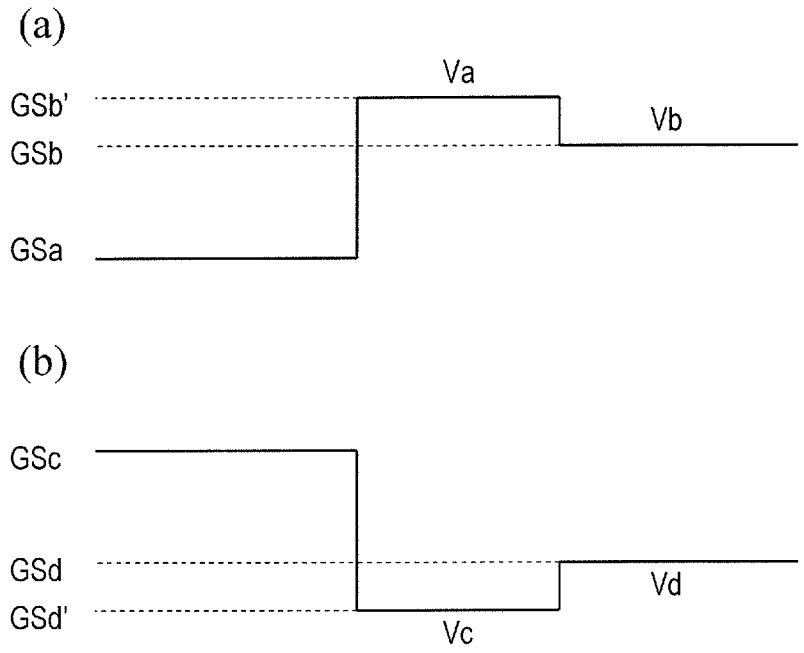
FIGS. 12 (*a*) and (*b*) schematically show how grayscale levels and effective voltages change in overdrive driving.

FIG. 12(*a*) shows how the effective voltage varies when the grayscale level of a primary color obtained through the multi-primary-color conversion changes from a grayscale level GSa into another grayscale level GSb. In this example, the grayscale level GSa corresponds to a low effective voltage and the grayscale level GSb corresponds to a high effective voltage. Since the liquid crystal layer of the liquid crystal panel 200 operates in the Normally Black mode as described above, the luminance associated with the grayscale level GSb is higher than the one associated with the grayscale level GSa.

The grayscale level GSb obtained through the multi-primary-color conversion is associated with the effective voltage Vb. However, in a vertical scanning period in which the grayscale level has changed from GSa into GSb, a different grayscale level GSb' is set as a result of the overdrive driving by the overdrive circuit 120 to replace the grayscale level GSb that has been obtained through the multi-primary-color conversion. As a result, an effective voltage VA is applied to the liquid crystal layer. Since the grayscale level GSb obtained through the multi-primary-color conversion is constant after that, no overdrive driving is carried out and an effective voltage Vb associated with the grayscale level GSb is applied to the liquid crystal layer. In this manner, when the grayscale level changes as the effective voltage varies from the low one into the high one, the overdrive circuit 120 sets a grayscale level that is even higher than the grayscale level obtained through the multi-primary-color conversion. Such a driving method is sometimes called "overshoot driving".

FIG. 12(*b*) shows how the effective voltage varies when the grayscale level of a primary color obtained through the multi-primary-color conversion changes from a grayscale level GSc into another grayscale level GSd. In this example, the grayscale level GSc corresponds to a high effective voltage and the grayscale level GSd corresponds to a low effective voltage. Since the liquid crystal layer of the liquid crystal panel 200 operates in the Normally Black mode as described above, the luminance associated with the grayscale level GSd is lower than the one associated with the grayscale level GSc.

The grayscale level GSd obtained through the multi-primary-color conversion is associated with the effective voltage Vd. However, in a vertical scanning period in which the grayscale level has changed from GSc into GSd, a different grayscale level GSd' is set as a result of the overdrive driving by the overdrive circuit 120 to replace the grayscale level GSd. As a result, an effective voltage Vc is applied to the liquid crystal layer. Since the grayscale level GSd obtained through the multi-primary-color conversion is constant after that, no overdrive driving is carried out and an effective voltage Vd associated with the grayscale level GSd is applied to the liquid crystal layer. In this manner, when the grayscale level changes as the effective voltage varies from the high one into the low one, the overdrive circuit 120 sets a grayscale level that is even lower than the grayscale level obtained through the multi-primary-color conversion. Such a driving method is sometimes called "undershoot driving".

Figure 13:
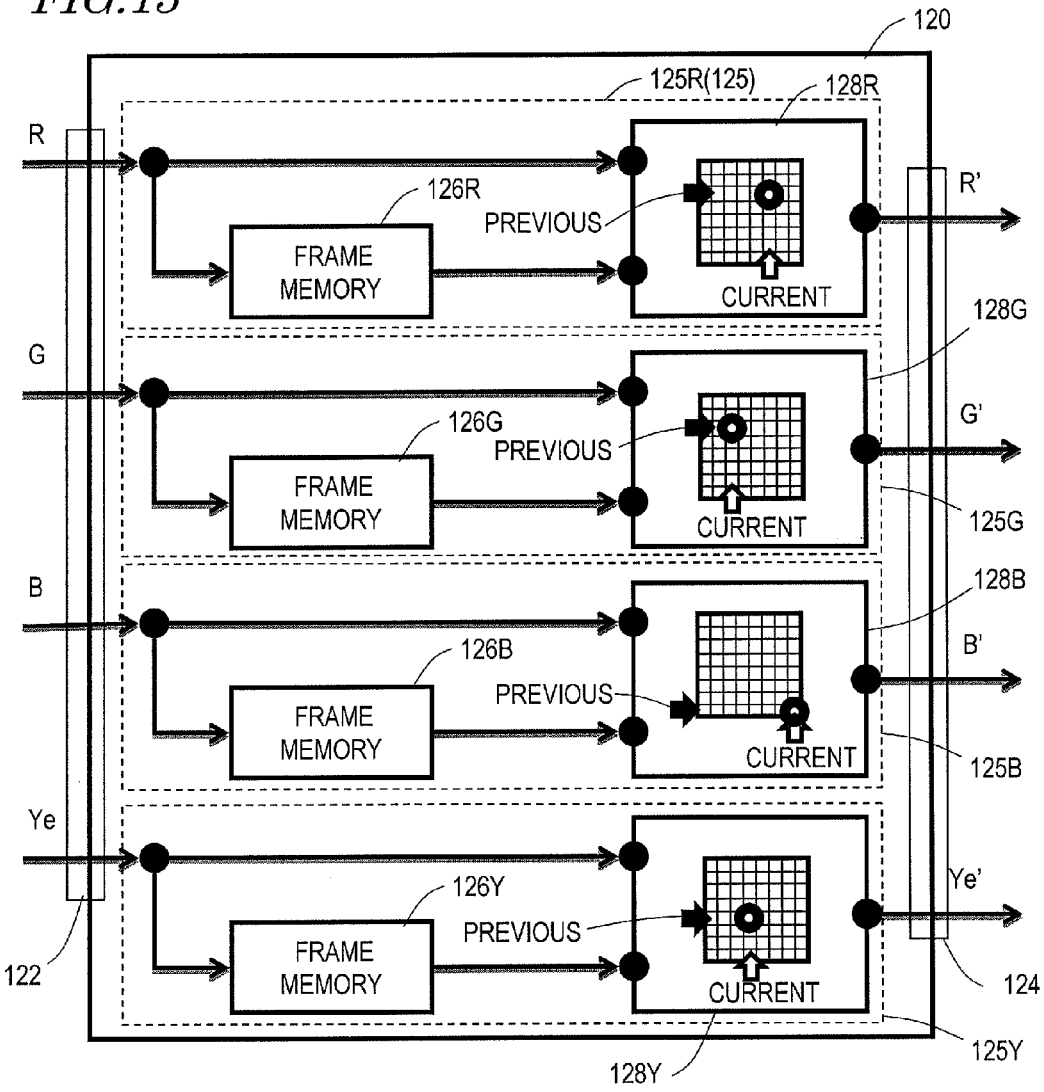
FIG. 13 Schematically illustrates the overdrive circuit shown in FIG. 1.

Hereinafter, a configuration for the overdrive circuit 120 will be described with reference to FIG. 13, which schematically illustrates the overdrive circuit 120. The overdrive circuit 120 includes an input terminal 122, an output terminal 124, and grayscale level setting circuits 125 which are provided for the respective primary colors. In this example, the grayscale level setting circuits 125 include red, green, blue, and yellow grayscale level setting circuits 125R, 125G, 125B and 125Y which are provided for the respective primary colors.

The grayscale levels R, G, B, Ye, represented by the multi-primary-color signal supplied from the overdrive circuit 120, are entered through the input terminal 122 and then subjected to overdrive driving by the red, green, blue, and yellow grayscale level setting circuits 125R, 125G, 125B and 125Y, respectively. As a result, grayscale levels R', G', B' and Ye' are obtained and a multi-primary-color signal representing those grayscale levels R', G', B' and Ye' is output.

Specifically, the red, green, blue, and yellow grayscale level setting circuits 125R, 125G, 125B and 125Y include frame memories 126R, 126G, 126B and 126Y and overdrive processing sections 128R, 128G, 128B and 128Y, respectively. The grayscale levels R, G, B and Ye obtained through the multi-primary-color conversion are input through the input terminal 122 of this overdrive circuit 120. The frame memories 126R, 126G, 126B and 126Y respectively store the grayscale levels R, G, B and Ye in the previous (typically one frame earlier) vertical scanning period. In the following description, the grayscale levels in the previous vertical scanning period will be sometimes referred to herein as "previous grayscale levels", the grayscale levels in the vertical scanning period that follows the former period as "current grayscale levels", and grayscale levels to be newly set based on those levels as "set grayscale levels", respectively.

The overdrive processing sections 128R, 128G, 128B and 128Y respectively set new grayscale levels R', G', B' and Ye' based on the previous grayscale levels R, G, B, Ye that are stored in the frame memories 126R, 126G, 126B and 126Y and current grayscale levels R, G, B, Ye. These levels may be set by reference to a lookup table, for example. Such a lookup table for use to determine a single set of grayscale levels R', G', B' and Ye' based on the grayscale levels R, G, B and Ye of two consecutive vertical scanning periods is sometimes called a "two-dimensional lookup table".

The following Table 2 is an example of such a lookup table that has been set:

TABLE 2

| | | current grayscale level | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| previous grayscale level | 0 | 0 | 24 | 48 | 72 | 96 | 120 | 144 | 168 | 192 | 216 | 240 | 255 | 255 | 255 | 255 | 255 | 255 |
| | 16 | 0 | 16 | 40 | 64 | 88 | 112 | 136 | 160 | 184 | 208 | 232 | 255 | 255 | 255 | 255 | 255 | 255 |
| | 32 | 0 | 7 | 32 | 56 | 80 | 104 | 128 | 152 | 176 | 200 | 224 | 248 | 255 | 255 | 255 | 255 | 255 |
| | 48 | 0 | 0 | 23 | 48 | 72 | 96 | 120 | 144 | 168 | 192 | 216 | 240 | 255 | 255 | 255 | 255 | 255 |
| | 64 | 0 | 0 | 15 | 39 | 64 | 88 | 112 | 136 | 160 | 184 | 208 | 232 | 255 | 255 | 255 | 255 | 255 |
| | 80 | 0 | 0 | 7 | 31 | 55 | 80 | 104 | 128 | 152 | 176 | 200 | 224 | 248 | 255 | 255 | 255 | 255 |
| | 96 | 0 | 0 | 0 | 23 | 47 | 71 | 96 | 120 | 144 | 168 | 192 | 216 | 240 | 255 | 255 | 255 | 255 |
| | 112 | 0 | 0 | 0 | 15 | 39 | 63 | 87 | 112 | 136 | 160 | 184 | 208 | 232 | 255 | 255 | 255 | 255 |
| | 128 | 0 | 0 | 0 | 7 | 31 | 55 | 79 | 103 | 128 | 152 | 176 | 200 | 224 | 248 | 255 | 255 | 255 |
| | 144 | 0 | 0 | 0 | 0 | 23 | 47 | 71 | 95 | 119 | 144 | 168 | 192 | 216 | 240 | 255 | 255 | 255 |
| | 160 | 0 | 0 | 0 | 0 | 15 | 39 | 63 | 87 | 111 | 135 | 160 | 184 | 208 | 232 | 255 | 255 | 255 |
| | 176 | 0 | 0 | 0 | 0 | 7 | 31 | 55 | 79 | 103 | 127 | 151 | 176 | 200 | 224 | 248 | 255 | 255 |
| | 192 | 0 | 0 | 0 | 0 | 0 | 23 | 47 | 71 | 95 | 119 | 143 | 167 | 192 | 216 | 240 | 255 | 255 |
| | 208 | 0 | 0 | 0 | 0 | 0 | 15 | 39 | 63 | 87 | 111 | 135 | 159 | 183 | 208 | 232 | 255 | 255 |
| | 224 | 0 | 0 | 0 | 0 | 0 | 7 | 31 | 55 | 79 | 103 | 127 | 151 | 175 | 199 | 224 | 248 | 255 |
| | 240 | 0 | 0 | 0 | 0 | 0 | 0 | 23 | 47 | 71 | 95 | 119 | 143 | 167 | 191 | 215 | 240 | 255 |
| | 255 | 0 | 0 | 0 | 0 | 0 | 0 | 16 | 40 | 64 | 88 | 112 | 136 | 160 | 184 | 208 | 232 | 255 |

For example, if the previous grayscale level is 48 and the current grayscale level is 96, then 120 is obtained as the set grayscale level. In this manner, if the current grayscale level is greater than the previous grayscale level, a grayscale level that is even greater than the current grayscale level is obtained as the set grayscale level through the overdrive driving. If the previous and current grayscale levels are both 96, then the set grayscale level becomes 96.

On the other hand, if the previous and current grayscale levels are 96 and 48, respectively, then 23 is obtained as the set grayscale level. If the grayscale level decreases in this manner, a grayscale level that is even smaller than the current grayscale level is obtained as the set grayscale level through the overdrive driving. If the previous and current grayscale levels are both 48, then the set grayscale level becomes 48. The parameters of such a lookup table are stored in the overdrive processing sections 128R, 128G, 128B, and 128Y. If at least one of the previous and current grayscale levels is not described on the lookup table, then the set grayscale level may be obtained by performing linear interpolation on a grayscale level that is close to the other one of the previous and current grayscale levels that is described on the lookup table.

Before being subjected to the overdrive driving adjustment, the lookup table defines the set grayscale level to be equal to the current grayscale level. For example, the overdrive driving adjustment described above is made on the overdrive processing sections 128R, 128G, 128B and 128Y. And that adjustment is suitably made on the overdrive processing sections 128R, 128G, 128B and 128Y individually. The overdrive driving adjustment is made by changing the lookup tables. The lookup tables that have been defined finally for the overdrive processing sections 128R, 128G, 128B and 128Y are slightly different from each other, albeit not significantly. And if those lookup tables are different from each other, the overdrive driving can be carried out even more appropriately on those grayscale levels R, G, B and Ye. Nevertheless, the lookup tables of the overdrive processing sections 128R, 128G, 128B and 128Y could be equal to each other. That is to say, the overdrive processing sections 128R, 128G, 128B and 128Y may share the same lookup table in common. As a result, the memory cost that would have to be paid to store the lookup tables of the overdrive processing sections 128R, 128G, 128B and 128Y can be saved.

Figure 14:
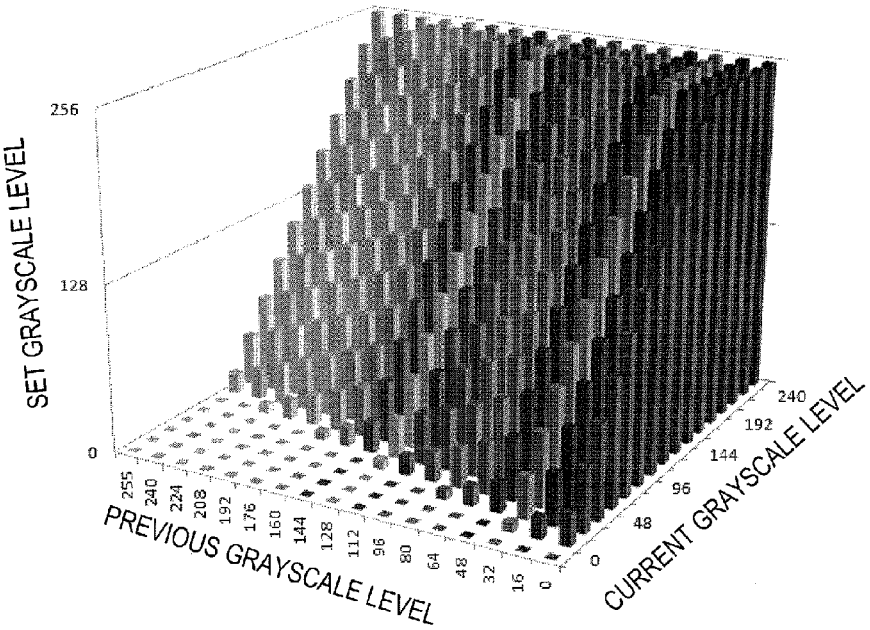
FIG. 14 Schematically shows a relation between previous, current and set grayscale levels.

FIG. 14 schematically illustrates the previous, current and set grayscale levels that are plotted based on Table 2. If the previous grayscale level is low, the set grayscale level can be defined to be relatively high even when the current grayscale level is not so high. On the other hand, if the previous grayscale level is high, the set grayscale level can be defined to be lower than the current grayscale level even when the current grayscale level has decreased relatively insignificantly from the previous grayscale level.

In the foregoing description, the overdrive circuit 120 is supposed to carry out overdrive driving based on the respective grayscale levels in the given and previous vertical scanning periods. However, this is just an example of the present invention. Alternatively, the overdrive circuit 120 may also carry out overdrive driving based on the respective grayscale levels in the given vertical scanning period and in a vertical scanning period that is earlier than the current one by two or more periods.

Also, the overdrive circuit 120 described above is supposed to perform both overshoot driving and undershoot driving. However, this is only an example of the present invention. Instead, the overdrive driving may also be set so that the overdrive circuit 120 performs only either the overshoot driving or the undershoot driving.

Embodiment 2

Figure 15:
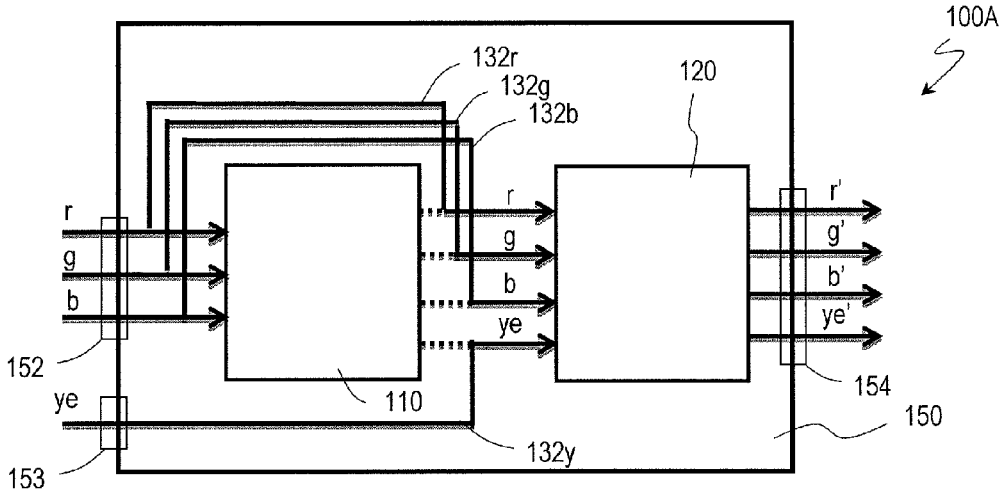
FIG. 15 Schematically illustrates a multi-primary-color liquid crystal panel driver as a second embodiment of the present invention.

Hereinafter, a second embodiment of a multi-primary-color liquid crystal panel driver according to the present invention will be described with reference to FIGS. 15 to 17. FIG. 15 schematically illustrates a configuration for a liquid crystal panel driver 100A. The multi-primary-color liquid crystal panel driver 100A of this embodiment has the same configuration as the multi-primary-color liquid crystal panel driver 100 described above except that this driver 100A includes an additional input terminal in addition to the input terminal and bypass paths. Thus, their common features will not be described all over again to avoid redundancies.

Just like the liquid crystal panel driver 100 shown in FIG. 2(*a*), the liquid crystal panel driver 100A also includes the multi-primary-color converter 110 and the overdrive circuit 120, which are integrated together on the same circuit chip 150. This liquid crystal panel driver 100A includes not only the input terminal 152, through which an input video signal representing the red, green and blue grayscale levels r, g, b is entered, but also an additional input terminal 153 and bypass paths 132*r*, 132*g*, 132*b*, and 132*y* as well. The bypass paths 132*r*, 132*g* and 132*b* connect the input terminal 152 to the overdrive circuit 120, while the bypass path 132*y* connects the additional input terminal 153 to the overdrive circuit 120. These input terminal 152 and additional input terminal 153 of the circuit chip 150 are connected to the overdrive circuit 120 through these bypass paths 132*r*, 132*g*, 132*b* and 132*y* without passing through the multi-primary-color converter 110.

Figure 16:
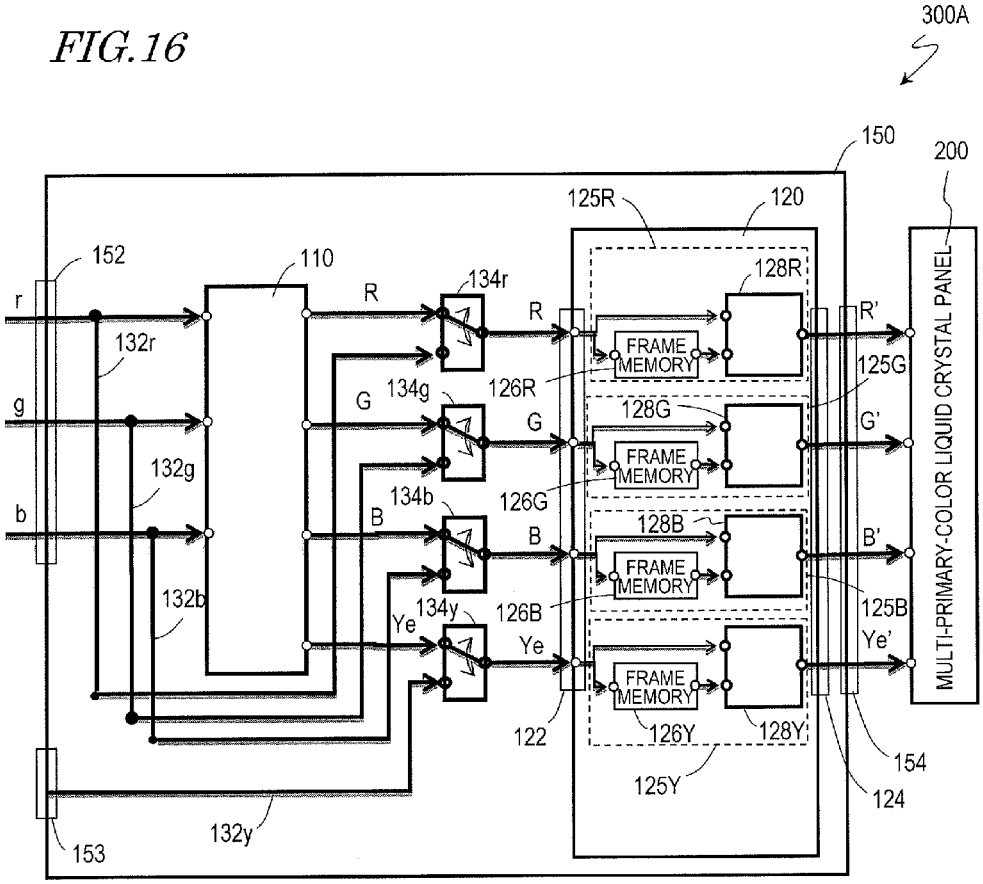
FIG. 16 Schematically illustrates a liquid crystal display device including the multi-primary-color liquid crystal panel driver shown in FIG. 15.
Figure 17:
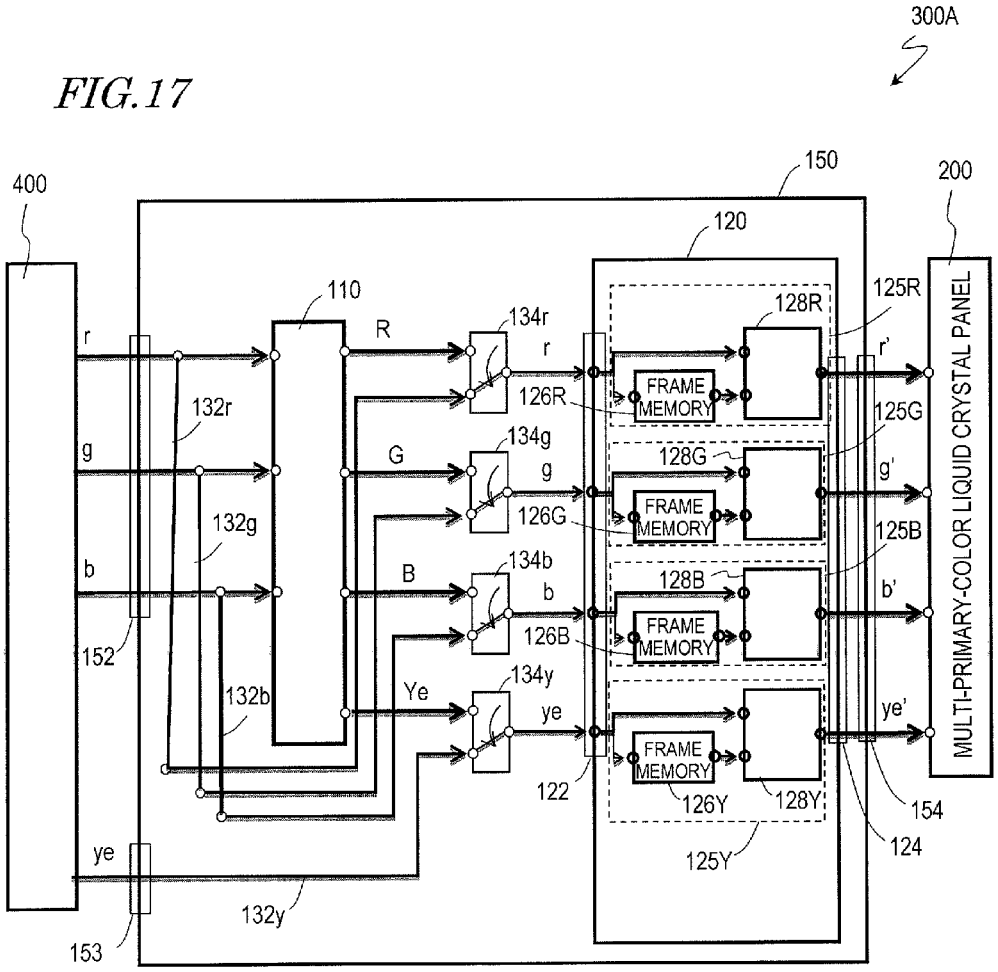
FIG. 17 Schematically illustrates how to set the mode of overdrive driving in the liquid crystal display device shown in FIG. 16.

FIG. 16 schematically illustrates a liquid crystal display device 300A including the liquid crystal panel driver 100A and the liquid crystal panel 200. The liquid crystal display device 300A of this embodiment has the same configuration as the liquid crystal display device 300 described above except that the liquid crystal panel driver 100 is replaced with the liquid crystal panel driver 100A. Thus, their common features will not be described all over again to avoid redundancies.

The liquid crystal panel driver 100A includes bypass paths 132*r*, 132*g*, 132*b* and 132*y* and switching elements 134*r*, 134*g*, 134*b*, and 134*y*. The switching elements 134*r*, 134*g*, 134*b*, and 134*y* can selectively connect either the multi-primary-color converter 110 or the bypass paths 132*r*, 132*g*, 132*b* and 132*y* to the overdrive circuit 120. In this example, the multi-primary-color converter 110 is connected to the overdrive circuit 120 with these switching elements 134*r*, 134*g*, 134*b*, and 134*y*. In this case, when an input video signal representing the grayscale levels r, g, b is entered through the input terminal 152, the multi-primary-color converter 110 converts the grayscale levels r, g, b of the input video signal into grayscale levels R, G, B and Ye. After that, the overdrive circuit 120 performs overdrive driving on these grayscale levels R, G, B and Ye, thereby obtaining grayscale levels R', G', B' and Ye'.

In this liquid crystal display device 300A, the mode of the overdrive driving may be set in the following manner. Hereinafter, it will be described with reference to FIG. 17 how to set the mode of overdrive driving for this liquid crystal display device 300A. First of all, a liquid crystal display device 300A including the liquid crystal panel driver 100A and the liquid crystal panel 200 is provided. Even though the overdrive driving will be adjusted as will be described later, before the overdrive driving is adjusted, the overdrive circuit 120 is designed so as to output the grayscale levels in the current vertical scanning period as they are without being affected by the grayscale levels in the previous vertical scanning period.

In this example, the bypass paths 132*r*, 132*g*, 132*b*, and 132*y* are connected to the overdrive circuit 120 via the switching elements 134*r*, 134*g*, 134*b* and 134*y*. Thus, the input terminal 152 and the additional input terminal 153 of the circuit chip 150 are connected to the input terminal 122 of the overdrive circuit 120 through the bypass paths 132*r*, 132*g*, 132*b* and 132*y* without passing through the multi-primary-color converter 110.

The overdrive driving may be set using a test signal generator 400, for example. The test signal generator 400 generates a test signal with red, green, blue, and yellow grayscale levels r, g, b, ye, which may be controlled arbitrarily.

The test signal with the grayscale levels r, g, b, ye is input through the input terminal 152 and the additional input terminal 153 and supplied to the overdrive circuit 120 by way of the bypass paths 132*r*, 132*g*, 132*b* and 132*y*. As described above, the overdrive driving is not adjusted yet in the beginning and the overdrive circuit 120 outputs the test signal with the grayscale levels r, g, b, ye to the liquid crystal panel 200. In response to this test signal, the liquid crystal panel 200 conducts a display operation, which is subjected to measurement.

After that, when the overdrive driving is adjusted, the overdrive circuit 120 converts the grayscale levels r, g, b, ye of the test signal into grayscale levels r', g', b', ye' and outputs a multi-primary-color signal with the grayscale levels r', g', b', ye' to the liquid crystal panel 200. In response to this multi-primary-color signal, the liquid crystal panel 200 conducts a display operation, which is subjected to measurement. In this manner, by making measurement on the display of the liquid crystal panel 200 while adjusting the overdrive driving, the mode of the overdrive driving can be set appropriately according to the liquid crystal panel 200. The test signal generator 400 can directly control the grayscale levels r, g, b, ye of the test signal. Consequently, the overdrive driving can be set on a primary color basis with respect to the overdrive circuit 120.

Embodiment 3

Figure 18:
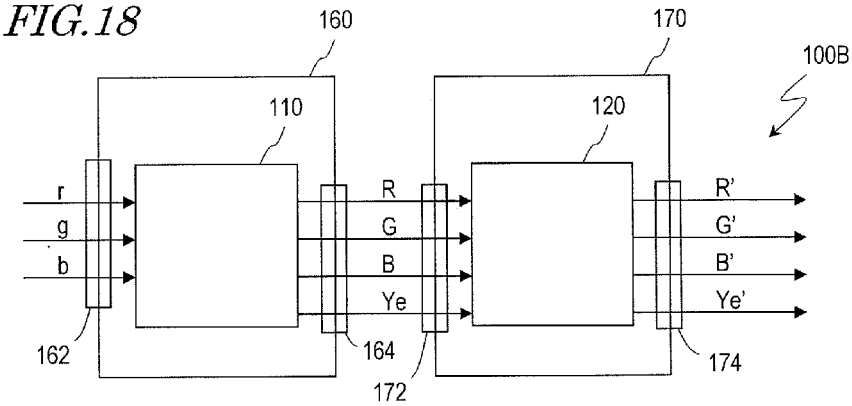
FIG. 18 Schematically illustrates a multi-primary-color liquid crystal panel driver as a third embodiment of the present invention.

Hereinafter, a third embodiment of a multi-primary-color liquid crystal panel driver according to the present invention will be described. FIG. 18 schematically illustrates a multi-primary-color liquid crystal panel driver 100B according to this embodiment. The liquid crystal panel driver 100B has the same configuration as the liquid crystal panel drivers 100 and 100A described above except that its multi-primary-color converter 110 and overdrive circuit 120 are arranged on two different circuit chips. Thus, their common features will not be described all over again to avoid redundancies.

In the liquid crystal panel driver 100B, the multi-primary-color converter 110 and the overdrive circuit 120 are arranged on circuit chips 160 and 170, respectively. These circuit chips 160 and 170 may be mounted on the frame area of the rear substrate of a multi-primary-color liquid crystal panel and lines that connect together the multi-primary-color converter 110 and the overdrive circuit 120 may be arranged in that frame area.

The circuit chip 160 includes an input terminal 162, the multi-primary-color converter 110 and an output terminal 164. An input video signal representing grayscale levels r, g, b is entered through the input terminal 162. The grayscale levels r, g, b are converted by the multi-primary-color converter 110 into grayscale levels R, G, B, Ye. And a multi-primary-color signal representing the grayscale levels R, G, B, Ye is output through the output terminal 164.

The circuit chip 170 includes an input terminal 172, the overdrive circuit 120 and an output terminal 174. The output terminal 164 of the circuit chip 160 is connected to the input terminal 172 of the circuit chip 170 through the lines that are arranged in the frame area of the rear substrate of the liquid crystal panel. The multi-primary-color signal representing the grayscale levels R, G, B and Ye is entered through the input terminal 172, and then subjected to overdrive driving by the overdrive circuit 120, thereby obtaining grayscale levels R', G', B' and Ye'. After that, a multi-primary-color signal representing the grayscale levels R', G', B' and Ye' is output through the output terminal 174. Although not shown in FIG. 18, the circuit chip 170 is arranged in a timing controller that controls the timings of gate and source signals that have been output from a gate driver and a source driver, respectively.

Figure 19:
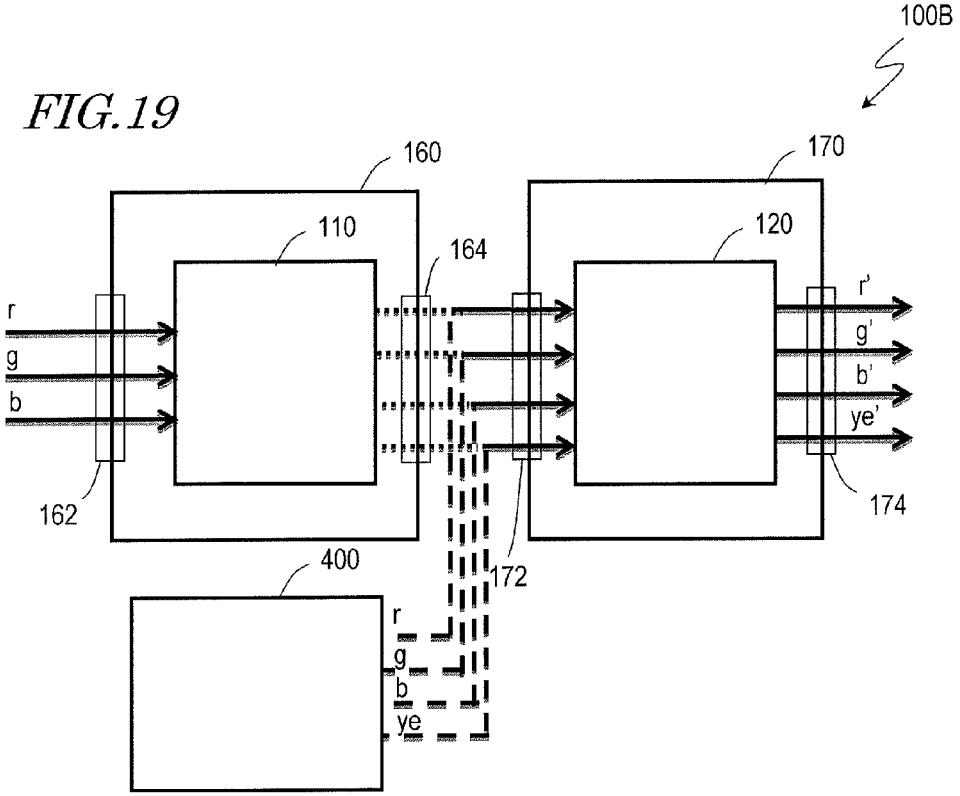
FIG. 19 Schematically illustrates how to set the mode of overdrive driving in the multi-primary-color liquid crystal panel driver shown in FIG. 18.

In this liquid crystal panel driver 100B, the mode of the overdrive driving may be set in the following manner. Hereinafter, it will be described with reference to FIG. 19 how to set the mode of the overdrive driving. Although not shown in FIG. 19, the liquid crystal panel driver 100B is connected to an liquid crystal panel. Even though the overdrive driving will be adjusted as will be described later, before the overdrive driving is adjusted, the overdrive circuit 120 is designed so as to output the grayscale levels in the current vertical scanning period as they are without being affected by the grayscale levels in the previous vertical scanning period.

The overdrive driving may be set using the test signal generator 400. The test signal generator 400 generates a test signal with red, green, blue, and yellow grayscale levels r, g, b, ye, which may be controlled arbitrarily. The test signal with the red, green, blue, and yellow grayscale levels r, g, b, ye is input through the input terminal 172 of the circuit chip 170. As described above, the overdrive driving is not adjusted yet in the beginning and the overdrive circuit 120 outputs the test signal with the grayscale levels r, g, b, ye to the liquid crystal panel. In response to this test signal, the liquid crystal panel conducts a display operation, which is subjected to measurement.

After that, when the overdrive driving is adjusted, the overdrive circuit 120 converts the grayscale levels r, g, b, ye of the test signal into grayscale levels r', g', b', ye' and outputs a multi-primary-color signal with the grayscale levels r', g', b', ye' to the liquid crystal panel. In response to this multi-primary-color signal, the liquid crystal panel conducts a display operation, which is subjected to measurement. In this manner, by making measurement on the display of the liquid crystal panel while adjusting the overdrive driving, the mode of the overdrive driving can be set appropriately according to the liquid crystal panel. The test signal generator 400 can directly control the grayscale levels r, g, b, ye of the test signal. Consequently, the overdrive driving can be set on a primary color basis with respect to the overdrive circuit 120.

As described above, in this liquid crystal panel driver 100B, the multi-primary-color converter 110 and the overdrive circuit 120 are arranged on two different circuit chips 160 and 170, respectively, and the mode of the overdrive driving can be set directly by inputting a test signal through the input terminal 172 of the circuit chip 170. That is why unlike the liquid crystal panel driver 100A that has been described with reference to FIGS. 15 through 17, the liquid crystal panel driver 100B does not have to be provided with any bypass paths 132*r*, 132*g*, 132*b* and 132*y*, switching elements 134*r*, 134*g*, 134*b* and 134*y*, or additional input terminal 153.

Figure 20:
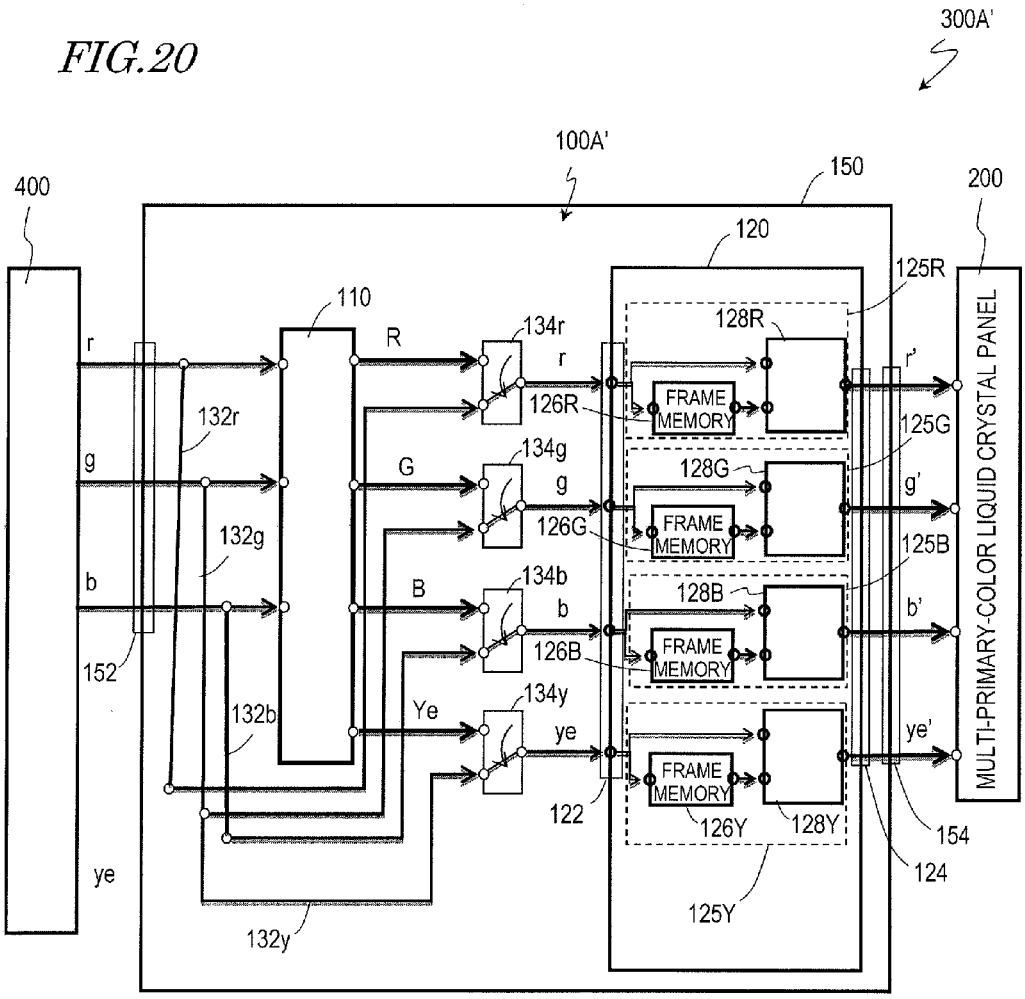
FIG. 20 Schematically illustrates a liquid crystal display device including a multi-primary-color liquid crystal panel driver as still another embodiment of the present invention.

In the liquid crystal panel drivers 100A and 100B described above, the mode of the overdrive driving is supposed to be set using a test signal with the grayscale levels r, g, b, ye in the same primary colors as the LC panel's 200. However, this is just an example of the present invention. Alternatively, by connecting together bypass paths 132*y* and 132*g* as in the liquid crystal display device 300A' shown in FIG. 20, the mode of the overdrive driving can also be set using a test signal representing the grayscale levels of the three primary colors. In that case, however, the same grayscale level will be supplied to grayscale level setting sections 125G and 125Y. That is why the display state of the liquid crystal panel 200 cannot be measured while either green pixels or yellow pixels are ON, for example. Consequently, if a color is represented with only the green pixels or the yellow pixels turned ON, sometimes the display quality cannot be improved sufficiently by the overdrive driving. Although the bypass paths 132*g* and 132*y* are connected together in this example, any two of the bypass paths 132*r*, 132*g*, 132*b*, and 132*y* may be connected together.

In the embodiments described above, the multi-primary-color converter 110 is supposed to convert the grayscale levels r, g, b of an input video signal into red, green, blue, and yellow grayscale levels R, G, B, Ye. However, this is just an example of the present invention. The multi-primary-color converter 110 may convert the grayscale levels r, g, b of the input video signal into the grayscale levels of a different set of four primary colors. Also, the multi-primary-color liquid crystal panel 200 may have a different combination of pixels from the combination of red, green, blue, and yellow pixels.

Also, in the embodiments described above, the multi-primary-color liquid crystal panel 200 is supposed to have red, green, blue, and yellow pixels and color representation is supposed to be carried out using color filters. However, this is only an example of the present invention. Alternatively, the multi-primary-color liquid crystal panel 200 may also be driven by sequential driving method in which each frame has sub-frames representing the colors red, green, blue, and yellow.

Furthermore, in the embodiments described above, the multi-primary-color converter 110 is supposed to perform a multi-primary-color conversion on the grayscale levels of four primary colors and the multi-primary-color liquid crystal panel 200 is supposed to conduct a display operation in those four primary colors. However, this is just an example of the present invention. Alternatively, the multi-primary-color converter 110 may also perform a multi-primary-color conversion on the grayscale levels of five or more (which is typically five or six) primary colors and the multi-primary-color liquid crystal panel 200 may conduct a display operation in those five or more primary colors. If a display operation is carried out in five or more primary colors, two or more additional input terminals such as the one shown in FIGS. 15 to 17 may be provided.

INDUSTRIAL APPLICABILITY

According to the present invention, even when the input video signal has varying grayscale levels, the display quality can be improved.

REFERENCE SIGNS LIST

100, 100A, 100E multi-primary-color liquid crystal panel driver
110 multi-primary-color converter
120 overdrive circuit
200 multi-primary-color liquid crystal panel
300, 300A, 300A' liquid crystal display device

The invention claimed is:

1. A multi-primary-color liquid crystal panel driver comprising:

a multi-primary-color converter which performs a multi-primary-color conversion to convert the grayscale levels of an input video signal in each of a plurality of vertical scanning periods into grayscale levels of four or more primary colors;

an overdrive circuit which receives four or more color signals corresponding to the four or more primary colors and which sets, based on the grayscale levels that have been subjected to the multi-primary-color conversion in one vertical scanning period and on the grayscale levels that have been subjected to the multi-primary-color conversion in another vertical scanning period that is earlier than the one vertical scanning period by at least one period, the grayscale levels of the four or more primary colors in that one vertical scanning period;

an input terminal, through which the input video signal, which contains three or more color signals corresponding to only some of the four or more primary colors, is input; and four or more bypass paths which respectively correspond to the four or more primary colors and which connect the input terminal to the overdrive circuit without passing through the multi-primary-color converter; wherein two of the four or more bypass paths are electrically connected together.

2. The multi-primary-color liquid crystal panel driver of claim 1, wherein the overdrive circuit includes a plurality of grayscale level setting circuits which are provided for the four or more primary colors.

3. The multi-primary-color liquid crystal panel driver of claim 1, further comprising:

a first circuit chip in which the multi-primary-color converter is built; and a second circuit chip in which the overdrive circuit is built.

4. The multi-primary-color liquid crystal panel driver of claim 1, further comprising at least one additional input terminal in addition to the input terminal, wherein at least one of the four or more bypass paths connect the input terminal and the additional input terminal to the overdrive circuit.

5. The multi-primary-color liquid crystal panel driver of claim 1, further comprising a switching element that selectively connects one of the multi-primary-color converter and the four or more bypass paths to the overdrive circuit.

6. The multi-primary-color liquid crystal panel driver of claim 1, further comprising a circuit chip in which the multi-primary-color converter and the overdrive circuit are integrated together.

7. The multi-primary-color liquid crystal panel driver of claim 1, wherein the multi-primary-color converter includes:

a color component extracting section which extracts color components from the grayscale levels of the input video signal; and a grayscale level allocating section which allocates the color components to the grayscale levels of the four or more primary colors.

8. The multi-primary-color liquid crystal panel driver of claim 1, wherein the multi-primary-color converter converts the grayscale levels of the input video signal into the grayscale levels of the colors red, green, blue and yellow.

9. The multi-primary-color liquid crystal panel driver of claim 1, wherein if any of the grayscale levels that have been subjected to the multi-primary-color conversion changes from a first grayscale level corresponding to a first effective voltage into a second grayscale level corresponding to a second effective voltage, which is higher than the first effective voltage, and then remains the second grayscale level for multiple vertical scanning periods, the overdrive circuit changes the grayscale level into a one corresponding to a higher effective voltage than the second grayscale level's in a vertical scanning period in which the first grayscale level has changed into the second grayscale level and then sets the grayscale level to be the second grayscale level in the vertical scanning periods in which the second grayscale level is maintained.

10. The multi-primary-color liquid crystal panel driver of claim 1, wherein if any of the grayscale levels that have been subjected to the multi-primary-color conversion changes from a third grayscale level corresponding to a third effective voltage into a fourth grayscale level corresponding to a fourth effective voltage, which is lower than the third effective voltage, and then remains the fourth grayscale level for multiple vertical scanning periods, the overdrive circuit changes the grayscale level into a one corresponding to a lower effective voltage than the fourth grayscale level's in a vertical scanning period in which the third grayscale level has changed into the fourth grayscale level and then sets the grayscale level to be the fourth grayscale level in the vertical scanning periods in which the fourth grayscale level is maintained.

11. A liquid crystal display device comprising:

a multi-primary-color liquid crystal panel; and the multi-primary-color liquid crystal panel driver of claim 1 which drives the multi-primary-color liquid crystal panel.

12. An overdrive driving setting method comprising the steps of:

providing a liquid crystal display device which includes a multi-primary-color liquid crystal panel and a multi-primary-color liquid crystal panel driver to drive the multi-primary-color liquid crystal panel, the liquid crystal panel driver including a multi-primary-color converter and an overdrive circuit;

making measurement on the display of the multi-primary-color liquid crystal panel while adjusting overdrive driving for the overdrive circuit by inputting four or more grayscale level adjustable test signals to the overdrive circuit without the four or more grayscale level adjustable test signals first passing through the multi-primary-color converter; and setting a mode of the overdrive driving to get done by the overdrive circuit based on a result of the measurement on the multi-primary-color liquid crystal panel; wherein two of the four or more grayscale level adjustable test signals have a same magnitude.

13. The multi-primary-color liquid crystal panel driver of claim 1, wherein two of the grayscale levels of the four or more primary colors have a same magnitude.

14. The multi-primary-color liquid crystal panel driver of claim 1, wherein the grayscale levels of the four or more primary colors include a yellow value and a green value which have a same magnitude.

15. The multi-primary-color liquid crystal panel driver of claim 1, wherein the four or more bypass paths include a bypass path which corresponds to yellow and a bypass path which corresponds to green, the bypass path which corresponds to yellow and the bypass path which corresponds to green are connected together.

* * * * *